US010360918B2

(12) United States Patent
Fueg et al.

(10) Patent No.: US 10,360,918 B2
(45) Date of Patent: Jul. 23, 2019

(54) REDUCTION OF COMB FILTER ARTIFACTS IN MULTI-CHANNEL DOWNMIX WITH ADAPTIVE PHASE ALIGNMENT

(71) Applicant: Fraunhofer-Gesellschaft zur Foerderung der angewandten Forschung e.V., Munich (DE)

(72) Inventors: Simone Fueg, Kalchreuth (DE); Achim Kuntz, Hemhofen (DE); Michael Kratschmer, Fuerth (DE); Juha Vilkamo, Helsinki (FI)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/000,508

(22) Filed: Jan. 19, 2016

(65) Prior Publication Data

US 2016/0133262 A1 May 12, 2016

Related U.S. Application Data

(63) Continuation of application No. PCT/EP2014/065537, filed on Jul. 18, 2014.

(30) Foreign Application Priority Data

Jul. 22, 2013 (EP) ..... 13177358
Oct. 18, 2013 (EP) ..... 13189287

(51) Int. Cl.
*H04R 5/00* (2006.01)
*G10L 19/008* (2013.01)
(Continued)

(52) U.S. Cl.
CPC ..... *G10L 19/008* (2013.01); *G10L 19/005* (2013.01); *G10L 19/0204* (2013.01);
(Continued)

(58) Field of Classification Search
CPC . G10L 19/008; G10L 19/005; G10L 19/0204; G10L 21/04; H04S 3/02; H04S 2400/01; H04S 2400/03; H04S 2420/03
(Continued)

(56) References Cited

U.S. PATENT DOCUMENTS

2004/0042504 A1 3/2004 Khoury, Jr. et al.
2009/0226010 A1 9/2009 Schnell et al.
(Continued)

FOREIGN PATENT DOCUMENTS

CN 1942929 A 4/2007
CN 101604983 A 12/2009
(Continued)

OTHER PUBLICATIONS

Breebaart, J.et al., "Parametric Coding of Steroaudio", EURASIP Journal on Applied Signal Processing, vol. 2005, 2005, pp. 1305-1322.
(Continued)

*Primary Examiner* — Vivian C Chin
*Assistant Examiner* — Ammar Hamid
(74) *Attorney, Agent, or Firm* — Perkins Coie LLP; Michael A. Glenn

(57) ABSTRACT

An audio signal processing decoder having at least one frequency band and being configured for processing an input audio signal having a plurality of input channels in the at least one frequency band, wherein the decoder is configured to analyze the input audio signal, wherein inter-channel dependencies between the input channels are identified; and to align the phases of the input channels based on the identified inter-channel dependencies, wherein the phases of input channels are the more aligned with respect to each other the higher their inter-channel dependency is; and to downmix the aligned input audio signal to an output audio
(Continued)

signal having a lesser number of output channels than the number of the input channels.

38 Claims, 10 Drawing Sheets

(51) Int. Cl.
*G10L 19/005* (2013.01)
*G10L 19/02* (2013.01)
*G10L 21/04* (2013.01)
*H04S 3/02* (2006.01)

(52) U.S. Cl.
CPC ..... *G10L 21/04* (2013.01); *H04S 3/02* (2013.01); *H04S 2400/01* (2013.01); *H04S 2400/03* (2013.01); *H04S 2420/03* (2013.01)

(58) Field of Classification Search
USPC ..... 381/22, 23, 17; 704/500; 375/240
See application file for complete search history.

(56) References Cited

U.S. PATENT DOCUMENTS

| | | | | |
|---|---|---|---|---|
| 2009/0299756 | A1 | 12/2009 | Davis et al. | |
| 2010/0241436 | A1 | 9/2010 | Kim et al. | |
| 2011/0112670 | A1 | 5/2011 | Disch et al. | |
| 2011/0255588 | A1* | 10/2011 | Shim | G10L 19/008 375/240 |
| 2011/0317842 | A1 | 12/2011 | Neusinger et al. | |
| 2012/0025962 | A1* | 2/2012 | Toll | B60Q 1/50 340/431 |
| 2013/0077793 | A1 | 3/2013 | Moon et al. | |

FOREIGN PATENT DOCUMENTS

| | | | | |
|---|---|---|---|---|
| CN | 102301420 | A | 12/2011 | |
| CN | 102428513 | A | 4/2012 | |
| EP | 2287836 | A1 * | 2/2011 | G10L 19/008 |
| JP | 2006050241 | A | 2/2006 | |
| JP | 2012524304 | A | 10/2012 | |
| KR | 20110108730 | A | 10/2011 | |
| RU | 2473140 | C2 | 1/2013 | |
| RU | 2487429 | C2 | 7/2013 | |
| WO | 2009115211 | A2 | 9/2009 | |
| WO | 2010042024 | A1 | 4/2010 | |
| WO | WO 2010042024 | A1 * | 4/2010 | G10L 19/008 |
| WO | 2010105695 | A1 | 9/2010 | |
| WO | 2011039668 | A1 | 4/2011 | |
| WO | 2012006770 | A1 | 1/2012 | |
| WO | 2012006776 | A1 | 1/2012 | |
| WO | 2012158705 | A1 | 11/2012 | |

OTHER PUBLICATIONS

Breebaart, J. et al., "Spatial Audio Processing: MPEG Surround and Other Applications", Wiley-Interscience, a method of phase alignment of two input signals, Mar. 11, 2008, 9 pages.

Herre, J. et al., "MPEG Surround—The ISO/MPEG Standard for Efficient and Compatible Multichannel Audio Coding", J. Audio Eng. Soc, vol. 56, No. 11, Nov. 2008, pp. 932-955.

Vilkamo, Juha et al., "Optimal Mixing Matrices and Usage of Decorrelators in Spatial Audio Processing", AES 45th International conference, Helsinki, Finland; Mar. 1-4, 2012, 8 pages.

Wu, et al., "Parametric Stereo Coding Scheme with a New Downmix Method and Whole Band Inter Channel Time/Phase Differences", ICASSP 2013—2013 IEEE International Conference on Acoustics, Speech and Signal Processing;, May 26-May 31, 2013, pp. 556-560.

"ATSC Standard: Digital Audio Compression (AC-3, E-AC-3)", Advanced Television Systems Committee. Doc.A/52:2012, Dec. 17, 2012, pp. 1-270.

Hyun et al., "Robust Interchannel Correlation (ICC) Estimation Using Constant Interchannel Time Difference (ICTD) Compensation", Audio Engineering Society Convention 127, Convention Paper 7934, Oct. 9-12, 2009, pp. 1-6.

* cited by examiner

REDUCTION OF COMB FILTER ARTIFACTS IN MULTI-CHANNEL DOWNMIX WITH ADAPTIVE PHASE ALIGNMENT

CROSS-REFERENCE TO RELATED APPLICATIONS

This application is a continuation of copending International Application No. PCT/EP2014/065537, filed Jul. 18, 2014, which claims priority from European Application No. 13177358.2, filed Jul. 22, 2013, and from European Application No. 13189287.9, filed Oct. 18, 2013, which are each incorporated herein in its entirety by this reference thereto.

BACKGROUND OF THE INVENTION

The present invention relates to audio signal processing, and, in particular, to a reduction of comb filter artifacts in a multi-channel downmix with adaptive phase alignment.

Several multi-channel sound formats have been employed, from the 5.1 surround that is typical to the movie sound tracks, to the more extensive 3D surround formats. In some scenarios it is necessitated to convey the sound content over a lesser number of loudspeakers.

Furthermore, in recent low-bitrate audio coding methods, such as described in J. Breebaart, S. van de Par, A. Kohlrausch, and E. Schuijers, "Parametric coding of stereoaudio," EURASIP Journal on Applied Signal Processing, vol. 2005, pp. 1305-1322, 2005 and J. Herre, K. Kjörling, J. Breebaart, C. Faller, S. Disch, H. Purnhagen, J. Koppens, J. Hilpert, J. Röden, W. Oomen, K. Linzmeier, and K. S. Chong, "MPEG Surround—The ISO/MPEG standard for efficient and compatible multichannel audio coding," J. Audio Eng. Soc, vol. 56, no. 11, pp. 932-955, 2008, the higher number of channels is transmitted as a set of downmix signals and spatial side information with which a multi-channel signal with the original channel configuration is recovered. These use cases motivate the development of downmix methods that preserve well the sound quality.

The simplest downmix method is the channel summation using a static downmix matrix. However, if the input channels contain sounds that are coherent but not aligned in time, the downmix signal is likely to attain perceivable spectral bias, such as the characteristics of a comb filter.

In J. Breebaart and C. Faller, "Spatial audio processing: MPEG Surround and other applications". Wiley-Interscience, 2008 a method of phase alignment of two input signals is described, which adjusted the phases of the input channels based on the estimated inter-channel phase difference parameter (ICPD) in frequency bands. The solution provides similar basic functionality as the method proposed in this paper, but is not applicable for downmix more than two inter-dependent channels.

In WO 2012/006770, PCT/CN2010/075107 (Huawei, Faller, Lang, Xu) a phase alignment processing is described for a two to one channel (stereo to mono) case. The processing is not directly applicable for multichannel audio.

In Wu et al, "Parametric Stereo Coding Scheme with a new Downmix Method and whole Band Inter Channel Time/Phase Differences", Proceedings of the ICASSP, 2013a method is described that uses whole-band inter-channel phase difference for stereo downmix. The phase of the mono signal is set to the phase difference between the left channel and the overall phase difference. Again, the method is just applicable for stereo to mono downmix. More than two inter-dependent channels cannot be downmixed with this method.

SUMMARY

An embodiment may have an audio signal processing decoder having at least one frequency band and being configured for processing an input audio signal having a plurality of input channels in the at least one frequency band, wherein the decoder is configured to align the phases of the input channels depending on inter-channel dependencies between the input channels, wherein the phases of input channels are the more aligned with respect to each other the higher their inter-channel dependency is; and to downmix the aligned input audio signal to an output audio signal having a lesser number of output channels than the number of the input channels.

Another embodiment may have an audio signal processing encoder having at least one frequency band and being configured for processing an input audio signal having a plurality of input channels in the at least one frequency band, wherein the encoder is configured to align the phases of the input channels depending on inter-channel dependencies between the input channels, wherein the phases of input channels are the more aligned with respect to each other the higher their inter-channel dependency is; and to downmix the aligned input audio signal to an output audio signal having a lesser number of output channels than the number of the input channels.

Still another embodiment may have an audio signal processing encoder having at least one frequency band and being configured for outputting a bitstream, wherein the bitstream contains an encoded audio signal in the frequency band, wherein the encoded audio signal has a plurality of encoded channels in the at least one frequency band, wherein the encoder is configured to calculate a downmix matrix for a downmixer for downmixing the encoded audio signal based on the downmix matrix in such way that the phases of the encoded channels are aligned based on identified inter-channel dependencies, advantageously in such way that the energy of an output audio signal of the downmixer is normalized based on determined energy of the encoded audio signal and to output the downmix matrix within the bitstream, wherein in particular the phases and/or amplitudes of downmix coefficients of the downmix matrix are formulated to be smooth over time, so that temporal artifacts due to signal cancellation between adjacent time frames are avoided and/or wherein in particular the phases and/or amplitudes of downmix coefficients of the downmix matrix are formulated to be smooth over frequency, so that spectral artifacts due to signal cancellation between adjacent frequency bands are avoided; and/or to establish an attraction value matrix by applying a mapping function, wherein the gradient of the mapping function is advantageously bigger or equal to zero for all covariance values or values derived from the covariance values and wherein the mapping function may reach values between zero and one for input values between zero and one, in particular a non-linear function, in particular a mapping function, which is equal to zero for covariance values or values derived from the covariance values being smaller than a first mapping threshold and/or which is equal to one for covariance values or values derived from the covariance values being bigger than a second mapping threshold and/or which is represented by a function forming an S-shaped curve, to the covariance value matrix or to a matrix derived from the covariance value matrix and to output the attraction value matrix within the bitstream; and/or to calculate a phase alignment coefficient matrix, wherein the phase alignment coefficient matrix is based on the covariance value matrix, and on a prototype downmix matrix.

According to another embodiment, a system may have: an audio signal processing decoder as mentioned above, and an audio signal processing encoder as mentioned above.

According to another embodiment, a method for processing an input audio signal having a plurality of input channels in a frequency band may have the steps of: analyzing the input audio signal in the frequency band, wherein inter-channel dependencies between the input audio channels are identified; aligning the phases of the input channels based on the identified inter-channel dependencies, wherein the phases of the input channels are the more aligned with respect to each other the higher their inter-channel dependency is; downmixing the aligned input audio signal to an output audio signal having a lesser number of output channels than the number of the input channels in the frequency band.

Another embodiment may have a computer program for implementing the method as mentioned above when being executed on a computer or signal processor.

An audio signal processing decoder having at least one frequency band and being configured for processing an input audio signal having a plurality of input channels in the at least one frequency band is provided. The decoder is configured to align the phases of the input channels depending on inter-channel dependencies between the input channels, wherein the phases of input channels are the more aligned with respect to each other the higher their inter-channel dependency is. Further, the decoder is configured to downmix the aligned input audio signal to an output audio signal having a lesser number of output channels than the number of the input channels.

The basic working principle of the decoder is that mutually dependent (coherent) input channels of the input audio signal attract each other in terms of the phase in the specific frequency band, while those input channels of the input audio signal that are mutually independent (incoherent) remain unaffected. The goal of the proposed decoder is to improve the downmix quality in respect to the post-equalization approach in critical signal cancellation conditions, while providing the same performance in non-critical conditions.

Further, at least some functions of the decoder may be transferred to the external device, such as an encoder, which provides the input audio signal. This may provide the possibility to react to signals, where a state of the art decoder might produce artifacts. Further, it is possible to update the downmix processing rules without changing the decoder and to ensure a high downmix quality. The transfer of functions of the decoder is described below in more details.

In some embodiments the decoder may be configured to analyze the input audio signal in the frequency band, in order to identify the inter-channel dependencies between the input audio channels. In this case the encoder providing the input audio signal may be a standard encoder as the analysis of the input audio signal is done by the decoder itself.

In embodiments the decoder may be configured to receive the inter-channel dependencies between the input channels from an external device, such as from an encoder, which provides the input audio signal. This version allows flexible rendering setups at the decoder, but needs more additional data traffic between the encoder and decoder, usually in the bitstream containing the input signal of the decoder.

In some embodiments the decoder may be configured to normalize the energy of the output audio signal based on a determined energy of the input audio signal, wherein the decoder is configured to determine the signal energy of the input audio signal.

In some embodiments the decoder may be configured to normalize the energy of the output audio signal based on a determined energy of the input audio signal, wherein the decoder is configured to receive the determined energy of the input audio signal from an external device, such as from an encoder, which provides the input audio signal.

By determining the signal energy of the input audio signal and by normalizing the energy of the output audio signal it may be ensured that the energy of the output audio signal has an adequate level compared to other frequency bands. For example, the normalization may be done in such way that the energy of each frequency band audio output signal is the same as the sum of the frequency band input audio signal energies multiplied with the squares of the corresponding downmixing gains.

In various embodiments the decoder may comprise a downmixer for downmixing the input audio signal based on a downmix matrix, wherein the decoder is configured to calculate the downmix matrix in such way that the phases of the input channels are aligned based on the identified inter-channel dependencies. Matrix operations are a mathematical tool for effective solving multidimensional problems. Therefore, using a downmix matrix provides a flexible and easy method to downmix the input audio signal to an output audio signal having a lesser number of output channels than the number of the input channels of the input audio signal.

In some embodiments the decoder comprises a downmixer for downmixing the input audio signal based on a downmix matrix, wherein the decoder is configured to receive a downmix matrix calculated in such way that the phases of the input channels are aligned based on the identified inter-channel dependencies from an external device, such as from an encoder, which provides the input audio signal. Hereby the processing complexity of the output audio signal in the decoder is strongly reduced.

In particular embodiments the decoder may be configured to calculate the downmix matrix in such way that the energy of the output audio signal is normalized based on the determined energy of the input audio signal. In this case the normalization of the energy of the output audio signal is integrated in the downmixing process, so that the signal processing is simplified.

In embodiments the decoder may be configured to receive the downmix matrix M calculated in such way that the energy of the output audio signal is normalized based on the determined energy of the input audio signal from an external device, such as from an encoder, which provides the input audio signal.

The energy equalizer step can either be included in the encoding process or be done in the decoder, because it is an uncomplicated and clearly defined processing step.

In some embodiments the decoder may be configured to analyze time intervals of the input audio signal using a window function, wherein the inter-channel dependencies are determined for each time frame.

In embodiments the decoder may be configured to receive an analysis of time intervals of the input audio signal using a window function, wherein the inter-channel dependencies are determined for each time frame, from an external device, such as from an encoder, which provides the input audio signal.

The processing may be in both cases done in an overlapping frame-wise manner, although other options are also readily available, such as using a recursive window for estimating the relevant parameters. In principle any window function may be chosen.

In some embodiments the decoder is configured to calculate a covariance value matrix, wherein the covariance values express the inter-channel dependency of a pair of input audio channels. Calculating a covariance value matrix is an easy way to capture the short-time stochastic properties of the frequency band which may be used in order to determine the coherence of the input channels of the input audio signal.

In embodiments the decoder is configured to receive a covariance value matrix, wherein the covariance values express the inter-channel dependency of a pair of input audio channel, from an external device, such as from an encoder, which provides the input audio signal. In this case the calculation of the covariance matrix may be transferred to the encoder. Then, the covariance values of the covariance matrix have to be transmitted in the bitstream between the encoder and the decoder. This version allows flexible rendering setups at the receiver, but needs additional data in the output audio signal.

In embodiments a normalized covariance value matrix maybe established, wherein the normalized covariance value matrix is based on the covariance value matrix. By this feature the further processing may be simplified.

In some embodiments the decoder may be configured to establish an attraction value matrix by applying a mapping function to the covariance value matrix or to a matrix derived from the covariance value matrix.

In some embodiments the gradient of the mapping function may be bigger or equal to zero for all covariance values or values derived from the covariance values.

In embodiments the mapping function may reach values between zero and one for input values between zero and one, In embodiments the decoder may be configured to receive an attraction value matrix A established by applying a mapping function to the covariance value matrix or to a matrix derived from the covariance value matrix. By applying a non-linear function to the covariance value matrix or to a matrix derived from the covariance value matrix, such as a normalized covariance matrix, the phase alignment may be adjusted in both cases.

The phase attraction value matrix provides control data in the form of phase attraction coefficients that determines the phase attraction between the channel pairs. The phase adjustments derived for each time frequency tile based on the measurement covariance value matrix so that the channels with low covariance values do not affect each other and that the channels with high covariance values are phase looked in respect to each other.

In some embodiments the mapping function is a non-linear function.

In embodiments the mapping function is equal to zero for covariance values or values derived from the covariance values being smaller than a first mapping threshold and/or wherein the mapping function is equal to one for covariance values or values derived from the covariance values being bigger than a second mapping threshold. By this feature the mapping function consists of three intervals. For all covariance values or values derived from the covariance values being smaller than the first mapping threshold the phase attraction coefficients are calculated to zero and hence, phase adjustment is not executed. For all covariance values or values derived from the covariance values being higher than the first mapping threshold but smaller than the second mapping threshold the phase attraction coefficients are calculated to a value between zero and one and hence, a partial phase adjustment is executed. For all covariance values or values derived from the covariance values being higher than the second mapping threshold the phase attraction coefficients are calculated to one and hence, a full phase adjustment is done.

An example is given by the following mapping function:

$$f(c'_{i,j})=\alpha_{i,j}=\max(0,\min(1,3c'_{i,j}-1)).$$

Another advantageous example is given as:

$$f(ICC_{A,B}) = T_{A,B} = \begin{cases} \min(0.25, \max(0, 0.625 \cdot ICC_{A,B} - 0.3)) & \text{for } A \neq B \\ 1 & \text{for } A = B \end{cases}$$

In some embodiments the mapping function may be represented by a function forming an S-shaped curve.

In certain embodiments the decoder is configured to calculate a phase alignment coefficient matrix, wherein the phase alignment coefficient matrix is based on the covariance value matrix and on a prototype downmix matrix.

In embodiments the decoder is configured to receive a phase alignment coefficient matrix, wherein the phase alignment coefficient matrix is based on the covariance value matrix and on a prototype downmix matrix, from an external device, such as from an encoder, which provides the input audio signal.

The phase alignment coefficient matrix describes the amount of phase alignment that is needed to align the non-zero attraction channels of the input audio signal.

The prototype downmix matrix defines, which of the input channels are mixed into which of the output channels. The coefficients of the downmix matrix maybe scaling factors for downmixing an input channel to an output channel.

It is possible to transfer the complete calculation of the phase alignment coefficient matrix to the encoder. The phase alignment coefficient matrix then needs to be transmitted in the input audio signal, but its elements are often zero and could be quantized in a motivated way. As the phase alignment coefficient matrix is strongly dependent on the prototype downmix matrix this matrix has to be known on the encoder side. This restricts the possible output channel configuration.

In some embodiments the phases and/or the amplitudes of the downmix coefficients of the downmix matrix are formulated to be smooth over time, so that temporal artifacts due to signal cancellation between adjacent time frames are avoided. Herein "smooth over time" means that no abrupt changes over time occur for the downmix coefficients. In particular, the downmix coefficients may change over time according to a continuous or to a quasi-continuous function.

In embodiments the phases and/or the amplitudes of the downmix coefficients of the downmix matrix are formulated to be smooth over frequency, so that spectral artifacts due to signal cancellation between adjacent frequency bands are avoided. Herein "smooth over frequency" means that no abrupt changes over frequency occur for the downmix coefficients. In particular, the downmix coefficients may change over frequency according to a continuous or to a quasi-continuous function.

In some embodiments the decoder is configured to calculate or to receive a normalized phase alignment coefficient matrix, wherein the normalized phase alignment coefficient matrix, is based on the phase alignment coefficient matrix. By this feature the further processing may be simplified.

In embodiments the decoder is configured to establish a regularized phase alignment coefficient matrix based on the phase alignment coefficient matrix.

In embodiments the decoder is configured to receive a regularized phase alignment coefficient matrix based on the phase alignment coefficient matrix from an external device, such as from an encoder, which provides the input audio signal.

The proposed downmix approach provides effective regularization in the critical condition of the opposite phase signals, where the phase alignment processing may abruptly switch its polarity.

The additional regularization step is defined to reduce cancellations in the transient regions between adjacent frames due to abruptly changing phase adjustment coefficients. This regularization and the avoidance of abrupt phase changes between adjacent time frequency tiles is an advantage of this proposed downmix. It reduces unwanted artifacts that can occur when the phase jumps between adjacent time frequency tiles or notches appear between adjacent frequency bands.

A regularized phase alignment downmix matrix is obtained by applying phase regularization coefficients $\theta_{i,j}$ to the normalized phase alignment matrix.

The regularization coefficients may be calculated in a processing loop over each time-frequency tile. The regularization may be applied recursively in time and frequency direction. The phase difference between adjacent time slots and frequency bands is taken into account and they are weighted by the attraction values resulting in a weighted matrix. From this matrix the regularization coefficients may be derived as discussed below in more detail.

In embodiments the downmix matrix is based on the regularized phase alignment coefficient matrix. In this way it is ensured that the downmix coefficients of the downmix matrix are smooth over time and frequency.

Moreover, an audio signal processing encoder having at least one frequency band and being configured for processing an input audio signal having a plurality of input channels in the at least one frequency band, wherein the encoder is configured to align the phases of the input channels depending on inter-channel dependencies between the input channels, wherein the phases of input channels are the more aligned with respect to each other the higher their inter-channel dependency is; and to downmix the aligned input audio signal to an output audio signal having a lesser number of output channels than the number of the input channels.

The audio signal processing encoder may be configured similarly to the audio signal processing decoder discussed in this application.

Further, an audio signal processing encoder having at least one frequency band and being configured for outputting a bitstream, wherein the bitstream contains an encoded audio signal in the frequency band, wherein the encoded audio signal has a plurality of encoded channels in the at least one frequency band, wherein the encoder is configured to determine inter-channel dependencies between the encoded channels of the input audio signal and to output the inter-channel dependencies within the bitstream; and/or to determine the energy of the encoded audio signal and to output the determined energy of the encoded audio signal within the bitstream; and/or to calculate a downmix matrix M for a downmixer for downmixing the input audio signal based on the downmix matrix in such way that the phases of the encoded channels are aligned based on the identified inter-channel dependencies, advantageously in such way that the energy of a output audio signal of the downmixer is normalized based on the determined energy of the encoded audio signal and to transmit the downmix matrix M within the bitstream, wherein in particular downmix coefficients of the downmix matrix are formulated to be smooth over time, so that temporal artifacts due to signal cancellation between adjacent time frames are avoided and/or wherein in particular downmix coefficients of the downmix matrix are formulated to be smooth over frequency, so that spectral artifacts due to signal cancellation between adjacent frequency bands are avoided; and/or to analyze time intervals of the encoded audio signal using a window function, wherein the inter-channel dependencies are determined for each time frame and to output the inter-channel dependencies for each time frame to within the bitstream; and/or to calculate a covariance value matrix, wherein the covariance values express the inter-channel dependency of a pair of encoded audio channels and to output the covariance value matrix within the bitstream; and/or to establish an attraction value matrix by applying a mapping function, wherein the gradient of the mapping function may be bigger or equal to zero for all covariance values or values derived from the covariance values and wherein the mapping function may reach values between zero and one for input values between zero and one, in particular a non-linear function, in particular a mapping function, which is equal to zero for covariance values being smaller than a first mapping threshold and/or which is equal to one for covariance values being bigger than a second mapping threshold and/or which is represented by a function forming an S-shaped curve, to the covariance value matrix or to a matrix derived from the covariance value matrix and to output the attraction value matrix within the bitstream; and/or to calculate a phase alignment coefficient matrix, wherein the phase alignment coefficient matrix is based on the covariance value matrix and on a prototype downmix matrix, and/or to establish a regularized phase alignment coefficient matrix based on the phase alignment coefficient matrix V and to output the regularized phase alignment coefficient matrix within the bitstream.

The bitstream of such encoders may be transmitted to and decoded by a decoder as described herein. For further details see the explanations regarding the decoder.

A system comprising an audio signal processing decoder according to the invention and an audio signal processing encoder according to the invention is also provided.

Furthermore, a method for processing an input audio signal having a plurality of input channels in a frequency band, the method comprising the steps: analyzing the input audio signal in the frequency band, wherein inter-channel dependencies between the input audio channels are identified; aligning the phases of the input channels based on the identified inter-channel dependencies, wherein the phases of the input channels are the more aligned with respect to each other the higher their inter-channel dependency is; and downmixing the aligned input audio signal to an output audio signal having a lesser number of output channels than the number of the input channels in the frequency band is provided.

Moreover, a computer program for implementing the method mentioned above when being executed on a computer or signal processor is provided.

BRIEF DESCRIPTION OF THE DRAWINGS

In the following, embodiments of the present invention are described in more detail with reference to the figures, in which.

DETAILED DESCRIPTION OF THE INVENTION

Before describing embodiments of the present invention, more background on state-of-the-art-encoder-decoder-systems is provided.

Figure 5:
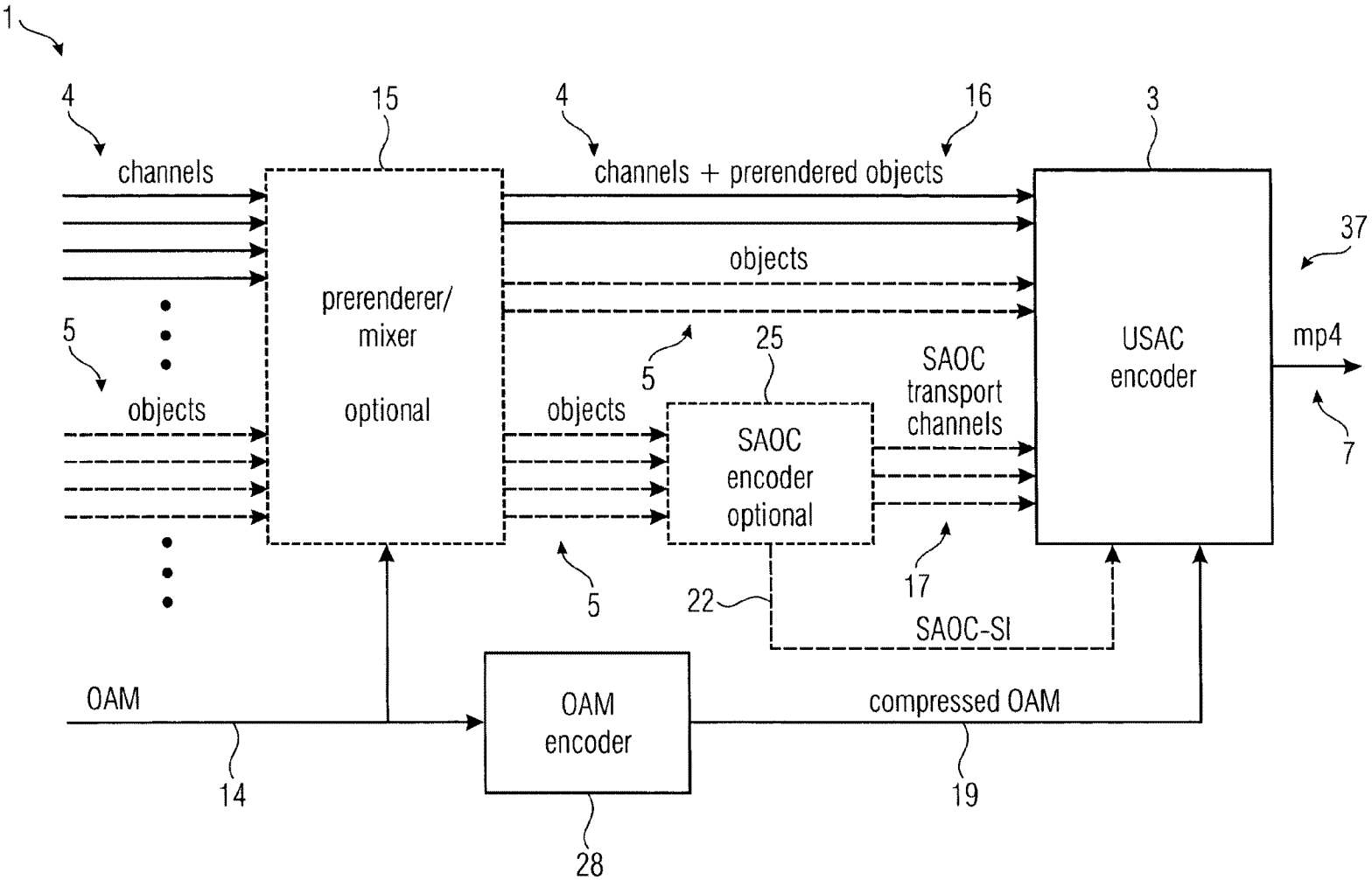
FIG. 5 shows a schematic block diagram of a conceptual overview of a 3D-audio encoder.
Figure 6:
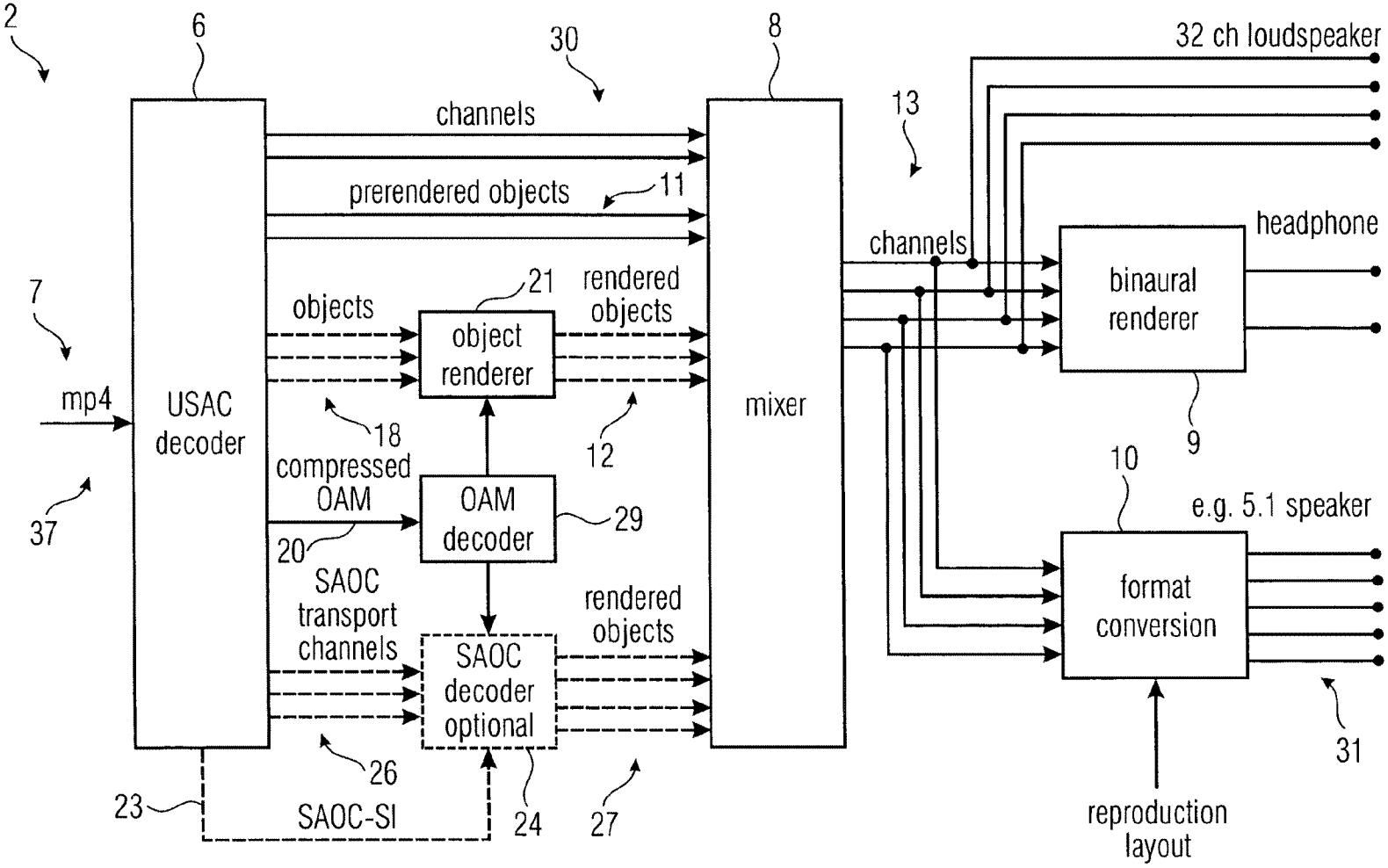
FIG. 6 shows a schematic block diagram of a conceptual overview of a 3D-audio decoder.

FIG. 5 shows a schematic block diagram of a conceptual overview of a 3D-audio encoder 1, whereas FIG. 6 shows a schematic block diagram of a conceptual overview of a 3D-audio decoder 2.

The 3D Audio Codec System 1, 2 may be based on a MPEG-D unified speech and audio coding (USAC) encoder 3 for coding of channel signals 4 and object signals 5 as well as based on a MPEG-D unified speech and audio coding (USAC) decoder 6 for decoding of the output audio signal 7 of the encoder 3.

The bitstream 7 may contain an encoded audio signal 37 referring to a frequency band of the encoder 1, wherein the encoded audio signal 37 has a plurality of encoded channels 38. The encoded signal 37 may be fed to a frequency band 36 (see FIG. 1) of the decoder 2 as an input audio signal 37.

To increase the efficiency for coding a large amount of objects 5, spatial audio object coding (SAOC) technology has been adapted. Three types of renderers 8, 9, 10 perform the tasks of rendering objects 11, 12 to channels 13, rendering channels 13 to headphones or rendering channels to a different loudspeaker setup.

When object signals are explicitly transmitted or parametrically encoded using SAOC, the corresponding Object Metadata (OAM) 14 information is compressed and multiplexed into the 3D-Audio bitstream 7.

The prerenderer/mixer 15 can be optionally used to convert a channel-and-object input scene 4, 5 into a channel scene 4, 16 before encoding. Functionally it is identical to the object renderer/mixer 15 described below.

Prerendering of objects 5 ensures deterministic signal entropy at the input of the encoder 3 that is basically independent of the number of simultaneously active object signals 5. With prerendering of objects 5, no object metadata 14 transmission is necessitated.

Discrete object signals 5 are rendered to the channel layout that the encoder 3 is configured to use. The weights of the objects 5 for each channel 16 are obtained from the associated object metadata 14.

The core codec for loudspeaker-channel signals 4, discrete object signals 5, object downmix signals 14 and prerendered signals 16 may be based on MPEG-D USAC technology. It handles the coding of the multitude of signals 4, 5, 14 by creating channel- and object mapping information based on the geometric and semantic information of the input's channel and object assignment. This mapping information describes, how input channels 4 and objects 5 are mapped to USAC-channel elements, namely to channel pair elements (CPEs), single channel elements (SCEs), low frequency effects (LFEs), and the corresponding information is transmitted to the decoder 6.

All additional payloads like SAOC data 17 or object metadata 14 may be passed through extension elements and may be considered in the rate control of the encoder 3.

The coding of objects 5 is possible in different ways, depending on the rate/distortion requirements and the interactivity requirements for the renderer. The following object coding variants are possible:

- Prerendered objects 16: Object signals 5 are prerendered and mixed to the channel signals 4, for example to 22.2 channels signals 4, before encoding. The subsequent coding chain sees 22.2 channel signals 4.
- Discrete object waveforms: Objects 5 are supplied as monophonic waveforms to the encoder 3. The encoder 3 uses single channel elements (SCEs) to transmit the objects 5 in addition to the channel signals 4. The decoded objects 18 are rendered and mixed at the receiver side. Compressed object metadata information 19, 20 is transmitted to the receiver/renderer 21 alongside.
- Parametric object waveforms 17: Object properties and their relation to each other are described by means of SAOC parameters 22, 23. The down-mix of the object signals 17 is coded with USAC. The parametric information 22 is transmitted alongside. The number of downmix channels 17 is chosen depending on the number of objects 5 and the overall data rate. Compressed object metadata information 23 is transmitted to the SAOC renderer 24.

The SAOC encoder 25 and decoder 24 for object signals 5 are based on MPEG SAOC technology. The system is capable of recreating, modifying and rendering a number of audio objects 5 based on a smaller number of transmitted channels 7 and additional parametric data 22, 23, such as object level differences (OLDs), inter-object correlations (IOCs) and downmix gain values (DMGs). The additional parametric data 22, 23 exhibits a significantly lower data rate than necessitated for transmitting all objects 5 individually, making the coding very efficient.

The SAOC encoder 25 takes as input the object/channel signals 5 as monophonic waveforms and outputs the parametric information 22 (which is packed into the 3D-Audio bitstream 7) and the SAOC transport channels 17 (which are encoded using single channel elements and transmitted). The SAOC decoder 24 reconstructs the object/channel signals 5 from the decoded SAOC transport channels 26 and parametric information 23, and generates the output audio scene 27 based on the reproduction layout, the decompressed object metadata information 20 and optionally on the user interaction information.

For each object 5, the associated object metadata 14 that specifies the geometrical position and volume of the object in 3D space is efficiently coded by an object metadata encoder 28 by quantization of the object properties in time and space. The compressed object metadata (cOAM) 19 is transmitted to the receiver as side information 20 which may be decoded bei an OAM-Decoder 29.

The object renderer 21 utilizes the compressed object metadata 20 to generate object waveforms 12 according to the given reproduction format. Each object 5 is rendered to certain output channels 12 according to its metadata 19, 20. The output of this block 21 results from the sum of the partial results. If both channel based content 11, 30 as well as discrete/parametric objects 12, 27 are decoded, the channel based waveforms 11, 30 and the rendered object waveforms 12, 27 are mixed before outputting the resulting waveforms 13 (or before feeding them to a postprocessor module 9, 10 like the binaural renderer 9 or the loudspeaker renderer module 10) by a mixer 8.

The binaural renderer module 9 produces a binaural downmix of the multi-channel audio material 13, such that each input channel 13 is represented by a virtual sound source. The processing is conducted frame-wise in a quadrature mirror filter (QMF) domain. The binauralization is based on measured binaural room impulse responses.

Figure 7:
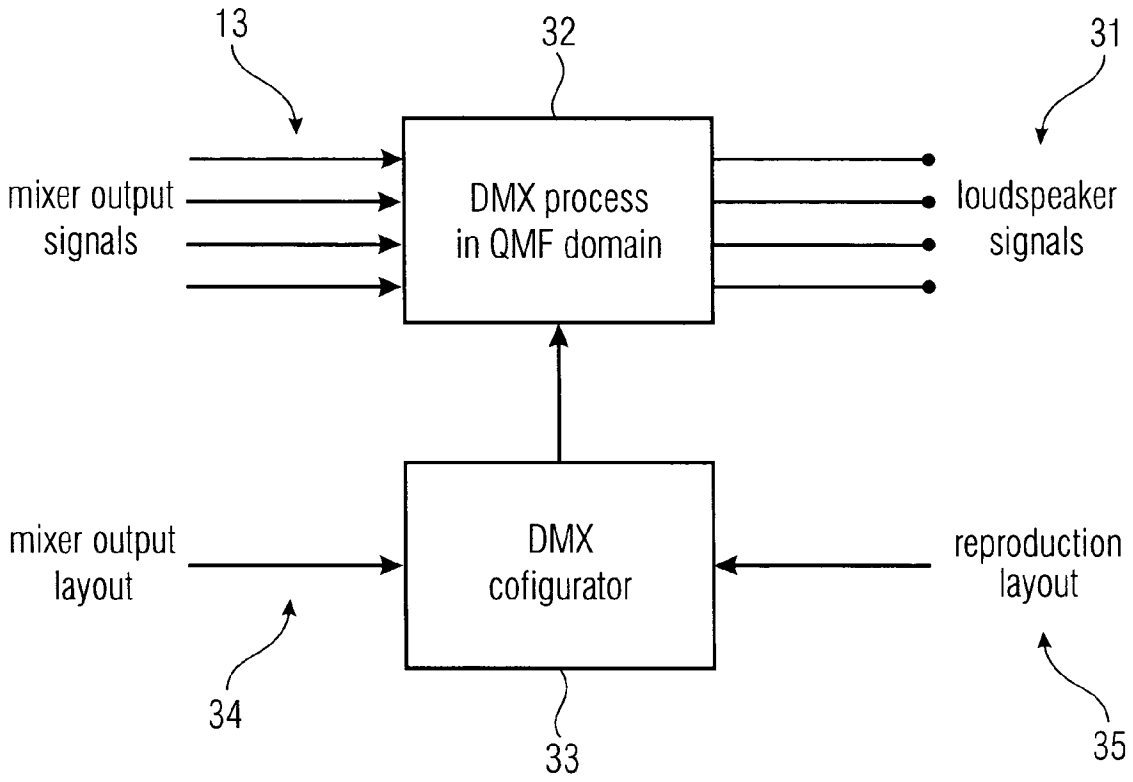
FIG. 7 shows a schematic block diagram of a conceptual overview of a format converter.

The loudspeaker renderer 10 shown in FIG. 7 in more details converts between the transmitted channel configuration 13 and the desired reproduction format 31. It is thus called 'format converter' 10 in the following. The format converter 10 performs conversions to lower numbers of output channels 31, i.e. it creates downmixes by a downmixer 32. The DMX configurator 33 automatically generates optimized downmix matrices for the given combination of input formats 13 and output formats 31 and applies these matrices in a downmix process 32, wherein a mixer output layout 34 and a reproduction layout 35 is used. The format converter 10 allows for standard loudspeaker configurations as well as for random configurations with non-standard loudspeaker positions.

Figure 1:
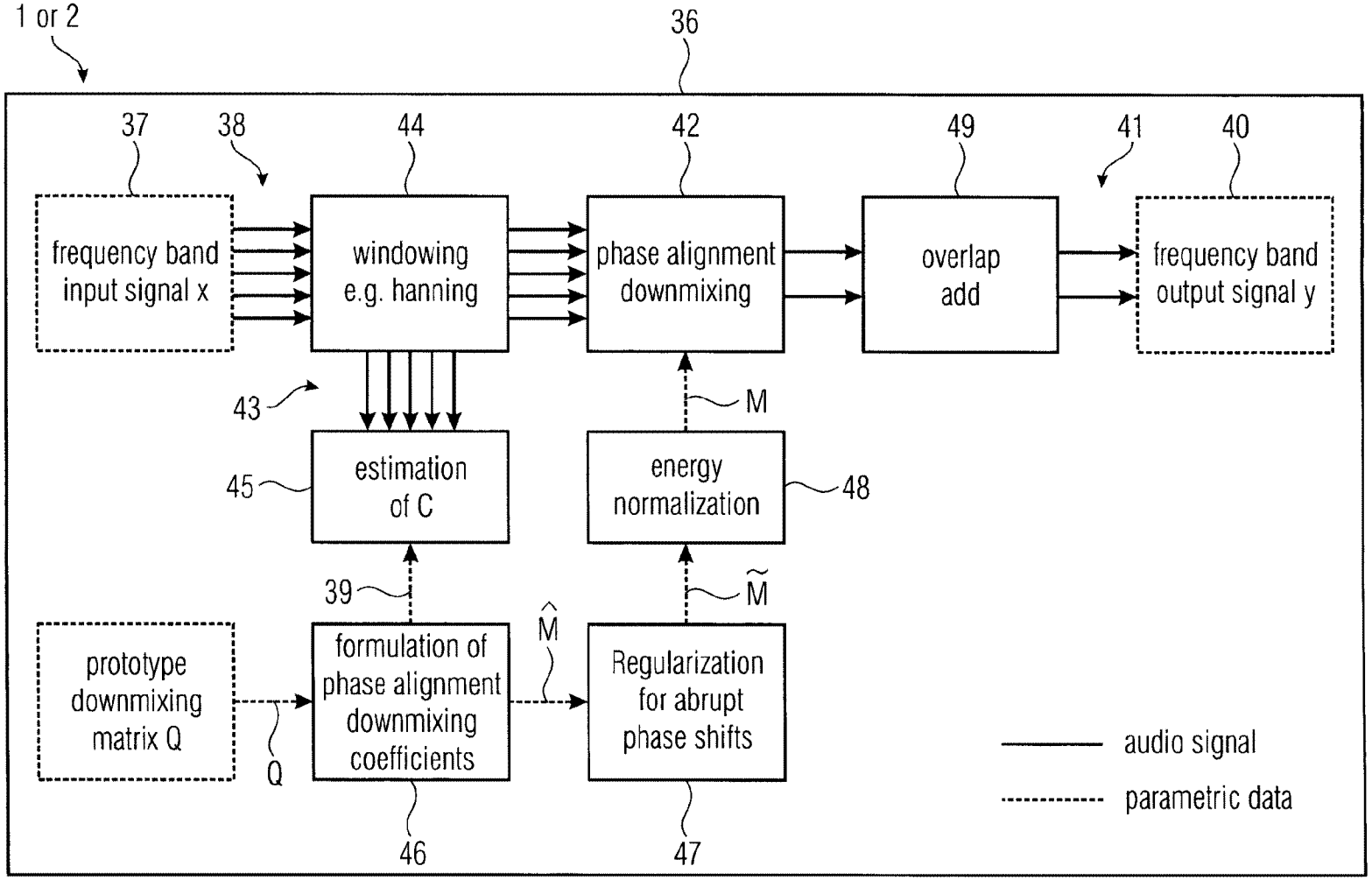
FIG. 1 shows a block diagram of a proposed adaptive phase alignment downmix.

FIG. 1 shows an audio signal processing device having at least one frequency band 36 and being configured for processing an input audio signal 37 having a plurality of input channels 38 in the at least one frequency band 36, wherein the device is configured to analyze the input audio signal 37, wherein inter-channel dependencies 39 between the input channels 38 are identified; and to align the phases of the input channels 38 based on the identified inter-channel dependencies 39, wherein the phases of input the channels 38 are the more aligned with respect to each other the higher their inter-channel dependency 39 is; and to downmix the aligned input audio signal to an output audio signal 40 having a lesser number of output channels 41 than the number of the input channels 38.

The audio signal processing device may be an encoder 1 or a decoder, as the invention is applicable for encoders 1 as well as for decoders.

The proposed downmixing method, presented as a block diagram in FIG. 1, is designed with the following principles:

1. The phase adjustments are derived for each time frequency tile based on the measured signal covariance matrix C so that the channels with low $c_{i,j}$ do not affect each other, and the channels with high $c_{i,j}$ are phase locked in respect to each other.
2. The phase adjustments are regularized over time and frequency to avoid signal cancellation artifacts due to the phase adjustment differences in the overlap areas of the adjacent time-frequency tiles.
3. The downmix matrix gains are adjusted so that the downmix is energy preserving.

The basic working principle of the encoder 1 is that mutually dependent (coherent) input channels 38 of the input audio signal attract each other in terms of the phase in the specific frequency band 36, while those input channels 38 of the input audio signal 37 that are mutually independent (incoherent) remain unaffected. The goal of the proposed encoder 1 is to improve the downmix quality in respect to the post-equalization approach in critical signal cancellation conditions, while providing the same performance in non-critical conditions.

An adaptive approach of downmix is proposed since inter-channel dependencies 39 are typically not known a priori.

The straightforward approach to revive the signal spectrum is to apply an adaptive equalizer 42 that attenuates or amplifies the signal in frequency bands 36. However, if there is a frequency notch that is much sharper than the applied frequency transform resolution, it is reasonable to expect that such an approach cannot recover the signal 41 robustly. This problem is solved by preprocessing the phases of the input signal 37 prior to the downmix, in order to avoid such frequency notches in the first place.

An embodiment according to the invention of a method to downmix two or more channels 38 to a lesser number of channels 41 adaptively in frequency bands 36, e.g. in so-called time-frequency tiles, is discussed below. The method comprises following features:

- Analysis of signal energies and inter-channel dependencies 39 (contained by the covariance matrix C) in frequency bands 36.
- Adjustment of the phases of the frequency band input channel signals 38 prior to the downmixing so that signal cancellation effects in downmixing are reduced and/or coherent signal summation is increased.
- Adjustments of the phases in such a way that a channel pair or group that have high interdependency (but potential phase offset) are more aligned in respect to each other, while channels that are less inter-dependent (also with a potential phase offset) are less or not at all phase aligned in respect to each other.
- The phase adjustment coefficients $\hat{M}$ are (optionally) formulated to be smooth over time, to avoid temporal artifacts due to signal cancellation between adjacent time frames.
- The phase adjustment coefficients $\hat{M}$ are (optionally) formulated to be smooth over frequency, to avoid spectral artifacts due to signal cancellation between adjacent frequency bands
- The energies of the frequency band downmix channel signals 41 are normalized, e.g. so that the energy of each frequency band downmix signal 41 is the same as the sum of the frequency band input signal 38 energies multiplied with the squares of the corresponding downmixing gains.

Furthermore, the proposed downmix approach provides effective regularization in the critical condition of the opposite phase signals, where the phase alignment processing may abruptly switch its polarity.

The subsequently provided mathematical description of the downmixer is a practical realization of the above. For an engineer skilled in the art, it is expectedly possible to formulate another specific realization that has the features according to the above description.

Figure 2:
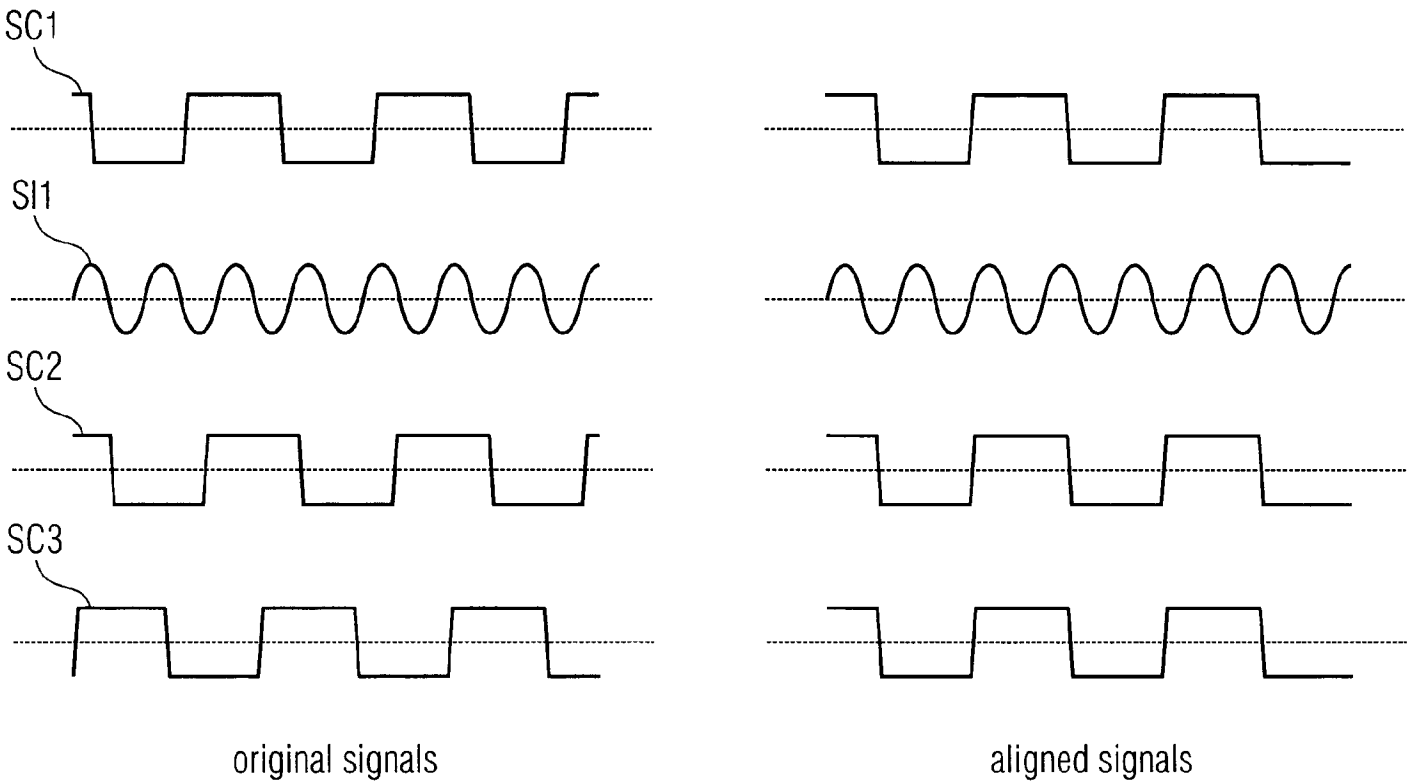
FIG. 2 shows the working principle of the proposed method, FIG. 3 describes the processing steps for the calculation of a downmix matrix M.

The basic working principle of the method, illustrated in FIG. 2, is that mutually coherent signals SC1, SC2, SC3 attract each other in terms of the phase in frequency bands 36, while those signals SI1 that are incoherent remain unaffected. The goal of the proposed method is simply to improve the downmix quality in respect to the post-equalization approach in the critical signal cancellation conditions, while providing the same performance in non-critical condition.

The proposed method was designed to formulate in frequency bands 36 adaptively a phase aligning and energy equalizing downmix matrix M, based on the short-time stochastic properties of the frequency band signal 37 and a static prototype downmix matrix Q. In particular, the method is configured to apply the phase alignment mutually only to those channels SC1, SC2, SC3 that are interdependent.

The general course of action is illustrated in FIG. 1. The processing is done in an overlapping frame-wise manner, although other options are also readily available, such as using a recursive window for estimating the relevant parameters.

For each audio input signal frame 43, a phase aligning downmix matrix M, containing phase alignment downmix coefficients, is defined depending on stochastic data of the input signal frame 43 and a prototype downmix matrix Q that defines which input channel 38 is downmixed to which output channel 41. The signal frames 43 are created in a windowing step 44. The stochastic data is contained by the complex-valued covariance matrix C of the input signal 37 estimated from the signal frame 43 (or e.g. using a recursive window) in an estimation step 45. From the complex-valued covariance matrix C a phase adjustment matrix M is derived in a step 46 named formulation of phase alignment downmixing coefficients.

Let the number of input channels be $N_x$ and the number of downmix channels $N_y<N_x$. The prototype downmix matrix Q and the phase aligning downmix matrix M are typically sparse and of dimension $N_y \times N_x$. The phase aligning downmix matrix M typically varies as a function of time and frequency.

The phase alignment downmixing solution reduces the signal cancellation between the channels, but may introduce cancellation in the transition region between the adjacent time-frequency tiles, if the phase adjustment coefficient changes abruptly. The abrupt phase change over time can occur when near opposite phase input signals are downmixed, but vary at least slightly in amplitude or phase. In this case the polarity of the phase alignment may switch rapidly, even if the signals themselves would be reasonably stable. This effect may occur for example when the frequency of a tonal signal component coincides with the inter-channel time difference, which in turn can root for example from the usage of the spaced microphone recording techniques or from the delay-based audio effects.

On frequency axis, the abrupt phase shift between the tiles can occur e.g. when two coherent but differently delayed wide band signals are downmixed. The phase differences become larger towards the higher bands, and wrapping at certain frequency band borders can cause a notch in the transition region.

The phase adjustment coefficients in $\hat{M}$ may be regularized in a further step to avoid processing artifacts due to sudden phase shifts, either over time, or over frequency, or both. In that way a regularized matrix $\tilde{M}$ may be obtained. If the regularization 47 is omitted, there may be signal cancellation artifacts due to the phase adjustment differences in the overlap areas of the adjacent time frames, and/or adjacent frequency bands.

The energy normalization 48 then adaptively ensures a motivated level of energy in the downmix signal(s) 40. The processed signal frames 43 are overlap-added in an overlap step 49 to the output data stream 40. Note that there are many variations available in designing such time-frequency processing structures. It is possible to obtain similar processing with a differing ordering of the signal processing blocks. Also, some of the blocks can be combined to a single processing step. Furthermore, the approach for windowing 44 or block processing can be reformulated in various ways, while achieving similar processing characteristics.

Figure 3:
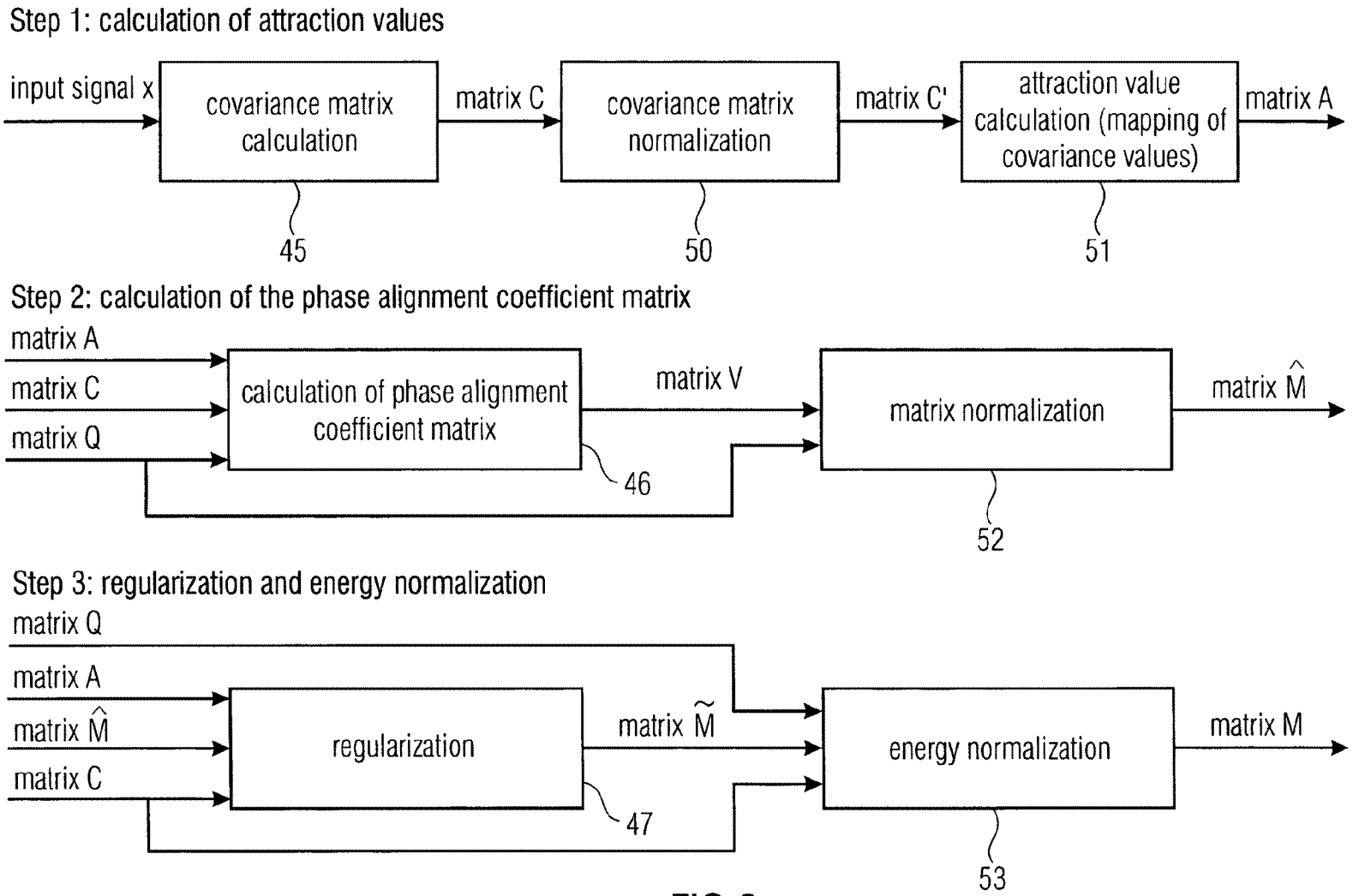

The different steps of the phase alignment downmixing are depicted in FIG. 3. After three overall processing steps a downmix matrix M is obtained, that is used to downmix the original multi-channel input audio signal 37 to a different channel number.

The detailed description of the various sub steps that are needed to calculate the matrix M are described below.

The downmix method according to an embodiment of the invention may be implemented in a 64-band QMF domain. A 64-band complex-modulated uniform QMF filterbank may be applied.

From the input audio signal x (which is equivalent to the input audio signal 38) in the time-frequency domain a complex-valued covariance matrix C is calculated as matrix $C=E\{x\,x^H\}$ where $E\{\cdot\}$ is the expectation operator and $x^H$ is the conjugate transpose of x. In practical implementation the expectation operator is replaced by a mean operator over several time and/or frequency samples.

The absolute value of this matrix C is then normalized in a covariance normalization step 50 such that it contains values between 0 and 1 (the elements are then called $c'_{i,j}$ and the matrix is then called C'. These values express the portion of the sound energy that is coherent between the different channel pairs, but may have a phase offset. In other words in-phase, out-of-phase, inverted-phase signals each produce the normalized value 1, while incoherent signals produce the value 0.

Figure 4:
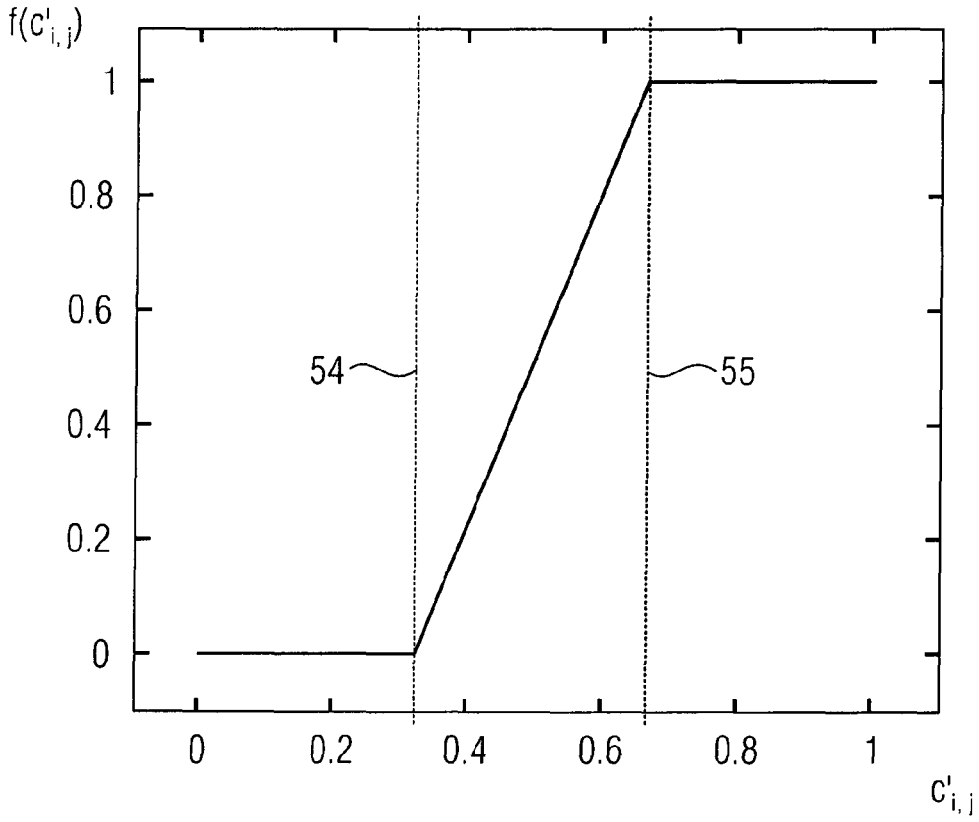
FIG. 4 shows a formula, which may be applied to a normalized covariance matrix C' for calculating an attraction value matrix A.

They are transformed in an attraction value calculation step 51 into control data (attraction value matrix A) that represents the phase attraction between the channel pairs by a mapping function $f(c'_{i,j})$ that is applied to all entries of the absolute normalized covariance matrix M'. Here, the formula $$f(c'_{i,j})=a_{i,j}=\max(0,\min(1,3c'_{i,j}-1))$$

may be used (see resulting mapping function in FIG. 4).

In this embodiment the mapping function $f(c'_{i,j})$ is equal to zero for normalized covariance values $c'_{i,j}$ being smaller than a first mapping threshold 54 and/or wherein the mapping function $f(c'_{i,j})$ is equal to one for normalized covariance values $c'_{i,j}$ being bigger than a second mapping threshold 55. By this feature the mapping function consists of three intervals. For all normalized covariance values $c'_{i,j}$ being smaller than the first mapping threshold 54 the phase attraction coefficients $a_{i,j}$ are calculated to zero and hence, phase adjustment is not executed. For all normalized covariance values $c'_{i,j}$ being higher than the first mapping threshold 54 but smaller than the second mapping threshold 55 the phase attraction coefficients $a_{i,j}$ are calculated to a value between zero and one and hence, a partial phase adjustment is executed. For all normalized covariance values $c'_{i,j}$ being higher than the second mapping threshold 55 the phase attraction coefficients $a_{i,j}$ are calculated to one and hence, a full phase adjustment is done.

From this attraction values, phase alignment coefficients $v_{i,j}$ are calculated. They describe the amount of phase alignment that is needed to align the non-zero attraction channels of signal x.

$$v_i = \mathrm{diag}(A \cdot D_{q_i^T} \cdot C_x)$$

with $D_{q_i^T}$ being a diagonal matrix with the elements of $q_i^T$ its diagonal. The result is a phase alignment coefficient matrix V.

The coefficients $v_{i,j}$ are then normalized in a phase alignment coefficient matrix normalization step 52 to the magnitude of the downmix matrix Q resulting in a normalized phase aligning downmix matrix $\hat{M}$ with the elements $$\hat{m}_{i,j} = \frac{q_{i,j}}{\|v_{i,j}\|} \cdot v_{i,j}$$

The advantage of this downmix is that channels 38 with low attraction do not affect each other, because the phase adjustments are derived from the measured signal covariance matrix C. Channels 38 with high attraction are phase locked in respect to each other. The strength of the phase modification depends on the correlation properties.

The phase alignment downmixing solution reduces the signal cancellation between the channels, but may introduce cancellation in the transition region between the adjacent time-frequency tiles, if the phase adjustment coefficient changes abruptly. The abrupt phase change over time can occur when near opposite phase input signals are downmixed, but vary at least slightly in amplitude or phase. In this case the polarity of the phase alignment can switch rapidly.

An additional regularization step 47 is defined that reduces cancellations in the transient regions between adjacent frames due to abruptly changing phase adjustment coefficients $v_{i,j}$. This regularization and the avoidance of abrupt phase changes between audio frames is an advantage of this proposed downmix. It reduces unwanted artifacts that can occur when the phase jumps between adjacent audio frames or notches between adjacent frequency bands.

There are various options to perform regularization to avoid large phase shifts between the adjacent time-frequency tiles. In one embodiment, a simple regularization method is used, described in detail in the following. In the method a processing loop may be configured to run for each tile in time sequentially from the lowest frequency tile to the highest, and phase regularization may be applied recursively in respect to the previous tiles in time and in frequency.

Figure 8:
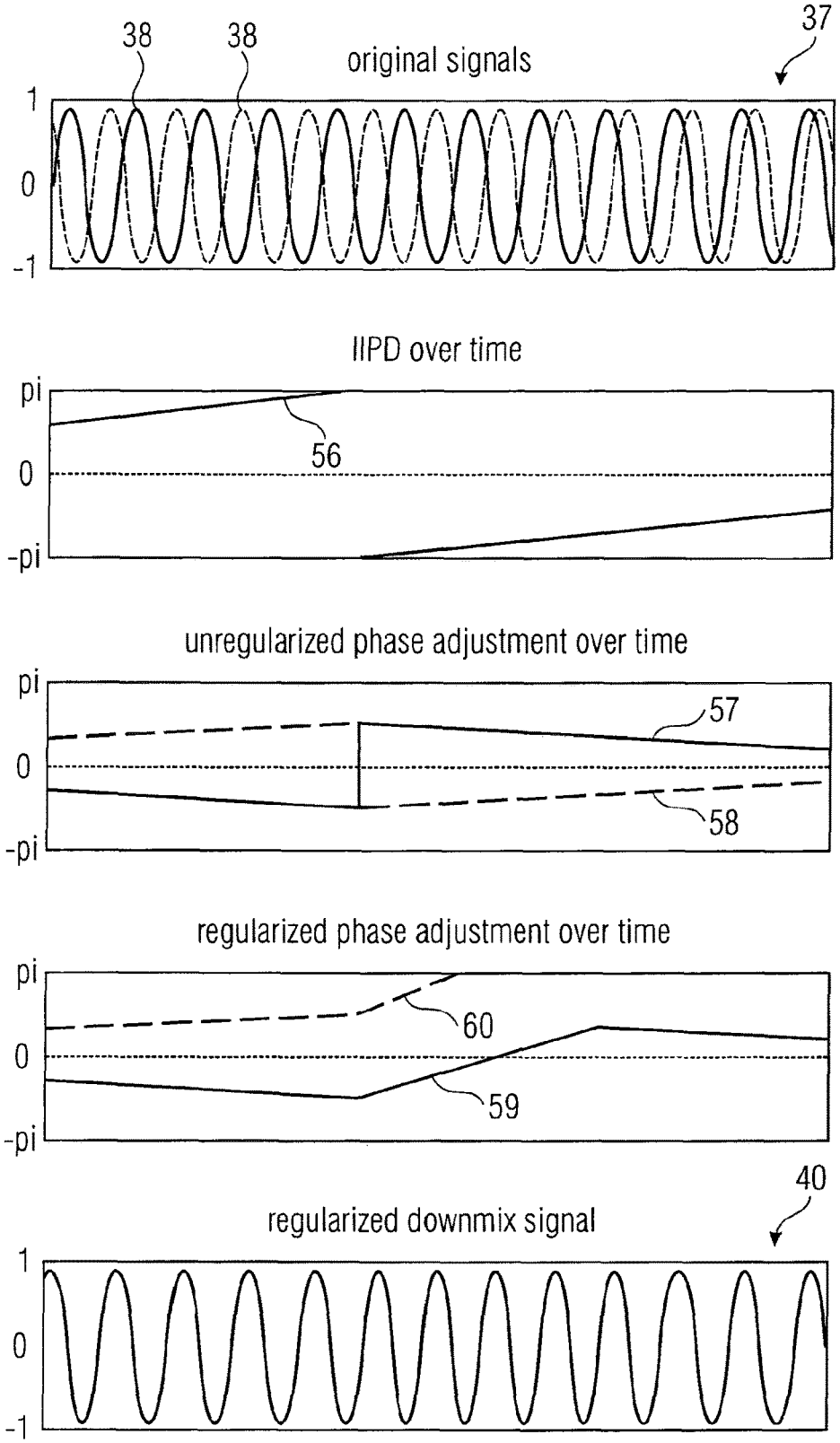
FIG. 8 shows an example of the processing of an original signal having two channels over time.
Figure 9:
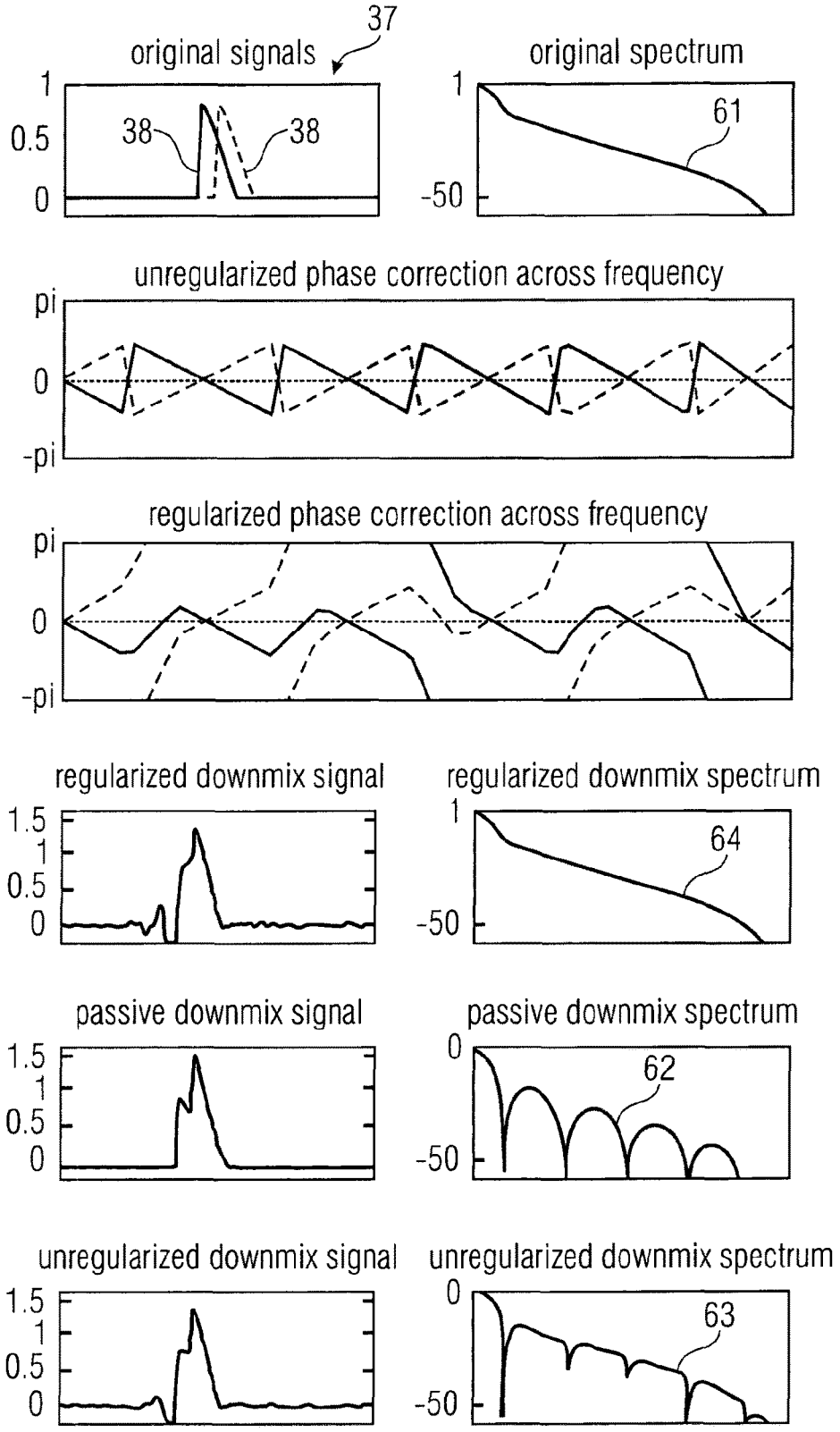
FIG. 9 shows an example of the processing of an original signal having two channels over frequency and FIG. 10 illustrates a 77 band hybrid filterbank.

The practical effect of the designed process, described in the following, is illustrated in FIGS. 8 and 9. FIG. 8 shows an example of an original signal 37 having two channels 38 over time. Between the two channels 38 exists a slowly increasing inter-channel phase difference (IPD) 56. The sudden phase shift from $+\pi$ to $-\pi$ results in an abrupt change of the unregularized phase adjustment 57 of the first channel 38 and of the unregularized phase adjustment 58 of the second channel 38.

However, the regularized phase adjustment 59 of the first channel 38 and regularized phase adjustment 60 of the second channel 38 do not show any abrupt changes.

FIG. 9 shows an example of an original signal 37 having two channels 38. Further, the original spectrum 61 of one channel 38 of the signal 37 is shown. The un-unaligned downmix spectrum (passive downmix spectrum) 62 shows comb filter effects. These comb filter effects are reduced in the unregularized downmix spectrum 63. However, such comb filter effects are not noticeable in the regularized downmix spectrum 64.

A regularized phase alignment downmix matrix $\tilde{M}$ may be obtained by applying phase regularization coefficients $\theta_{i,j}$ to the matrix $\hat{M}$.

The regularization coefficients are calculated in a processing loop over each time-frequency frame. The regularization 47 is applied recursively in time and frequency direction. The phase difference between adjacent time slots and frequency bands is taken into account and they are weighted by the attraction values resulting in a weighted matrix $M_{dA}$. From this matrix the regularization coefficients are derived:

$$\hat{\theta}_{i,j} = -\arctan\frac{\mathrm{Im}\{m_{dA_{i,j}}\}}{\mathrm{Re}\{m_{dA_{i,j}}\}}$$

Constant phase offsets are avoided by implementing the regularization to wear off towards zero by a step between 0 and $$\frac{\pi}{2},$$

that is dependent on the relative signal energy:

$$\theta_{i,j} = \mathrm{sign}(\hat{\theta}_{i,j}) \cdot \max(0, \|\hat{\theta}_{i,j}\| - \theta_{diff_{i,j}}) \text{ with}$$

$$\theta_{diff_{i,j}} = \frac{0.5\pi \cdot \|\hat{m}_{w_{i,j}}(k, l)\|^2}{\|\hat{m}_{w_{i,j}}(k, l)\|^2 + \|\hat{m}_{w_{i,j}}(k-1, l)\|^2 + \|\hat{m}_{w_{i,j}}(k, l-1)\|^2}$$

The entries of the regularized phase alignment downmix matrix $\tilde{M}$ are:

$$\tilde{m}_{i,j} = \hat{m}_{i,j} \cdot e^{i2\pi\Theta_{i,j}}.$$

Finally, an energy-normalized phase alignment downmix vector is defined in an energy normalization step 53 for each channel j, forming the rows of the final phase alignment downmix matrix:

$$m_j^T = \tilde{m}_j^T \cdot \sqrt{\frac{\sum_{k=1}^{N} c_{k,k} \cdot q_{j,k}^2}{\tilde{m}_j^T \cdot C \cdot \tilde{m}_j^*}}$$

After the calculation of the matrix M the output audio material is calculated. The QMF-domain output channels are weighted sums of the QMF-input channels. The complex-valued weights that incorporate the adaptive phase alignment process are the elements of the matrix M:

$$y = M \cdot x$$

It is possible to transfer some processing steps to the encoder 1. This would strongly reduce the processing complexity of the downmix 7 in the decoder 2. It would also provide the possibility to react to input audio signals 37, where the standard version of the downmixer would produce artifacts. It would then be possible to update the downmix processing rules without changing the decoder 2 and the downmix quality could be enhanced.

There are multiple possibilities which part of the phase alignment downmix can be transferred to the encoder 1. It is possible to transfer the complete calculation of the phase alignment coefficients $v_{i,j}$ to the encoder 1. The phase alignment coefficients $v_{i,j}$ then need to be transmitted in the bitstream 7, but they are often zero and could be quantized in a motivated way. As the phase alignment coefficients $v_{i,j}$ are strongly dependent on the prototype downmix matrix Q this matrix Q has to be known on the encoder side. This restricts the possible output channel configuration. The equalizer or energy normalization step could then either be included in the encoding process or still be done in the decoder 2, because it is an uncomplicated and clearly defined processing step.

Another possibility is to transfer the calculation of the covariance matrix C to the encoder 1. Then, the elements of the covariance matrix C have to be transmitted in the bitstream 7. This version allows flexible rendering setups at the receiver 2, but needs more additional data in the bitstream 7.

In the following an embodiment of the invention is described.

Audio signals 37 that are fed into the format converter 42 are referred to as input signals in the following. Audio signals 40 that are the result of the format conversion process are referred to as output signals. Note that the audio input signals 37 of the format converter are audio output signals of the core decoder 6.

Vectors and matrices are denoted by bold-faced symbols. Vector elements or matrix elements are denotes with italic variables supplemented by indices indicating the row/column of the vector/matrix element in the vector/matrix, e.g. $[y_1, \ldots y_A \ldots y_N]=y$ denotes a vector and its elements. Similarly, $M_{a,b}$ denotes the element in the ath row and bth column of a matrix M.

Following variables are used:

$N_{in}$ Number of channels in the input channel configuration $N_{out}$ Number of channels in the output channel configuration $M_{DMX}$ Downmix matrix containing real-valued non-negative downmix coefficients (downmix gains), $M_{DMX}$ is of dimension $(N_{out} \times N_{in})$ $G_{EQ}$ Matrix consisting of gain values per processing band determining frequency responses of equalizing filters $I_{EQ}$ Vector signalling which equalizer filters to apply to the input channels (if any)

L Frame length measured in time domain audio samples v Time domain sample index n QMF time slot index (=subband sample index)

$L_n$ Frame length measured in QMF slots

F Frame index (frame number)

K Number of hybrid QMF frequency bands, K=77 k QMF band index (1 . . . 64) or hybrid QMF band index (1 . . . K)

A,B Channel indices (channel numbers of channel configurations)

eps Numerical constant, eps=$10^{-35}$

An initialization of the format converter 42 is carried out before processing of the audio samples delivered by the core decoder 6 takes place.

The initialization takes into account as input parameters

The sampling rate of the audio data to process.

A parameter format_in signaling the channel configuration of the audio data to process with the format converter.

A parameter format_out signaling the channel configuration of the desired output format.

Optional: Parameters signaling the deviation of loudspeaker positions from a standard loudspeaker setup (random setup functionality).

It returns

The number of channels of the input loudspeaker configuration, $N_{in}$, the number of channels of the output loudspeaker configuration, $N_{out}$, a downmix matrix $M_{DMX}$ and equalizing filter parameters $(I_{EQ}, G_{EQ})$ that are applied in the audio signal processing of the format converter 42.

Trim gain and delay values ($T_{g,A}$ and $T_{d,A}$) to compensate for varying loudspeaker distances.

The audio processing block of the format converter 42 obtains time domain audio samples 37 for $N_{in}$ channels 38 from the core decoder 6 and generates a downmixed time domain audio output signal 40 consisting of $N_{out}$ channels 41.

The processing takes as input

The audio data decoded by the core decoder 6, the downmix matrix $M_{DMX}$ returned by the initialization of the format converter 42, the equalizing filter parameters $(I_{EQ}, G_{EQ})$ returned by the initialization of the format converter 42.

It returns an $N_{out}$-channel time domain output signal 40 for the format_out channel configuration signaled during the initialization of the format converter 42.

The format 42 converter may operate on contiguous, non-overlapping frames of length L=2048 time domain samples of the input audio signals and outputs one frame of L samples per processed input frame of length L.

Further, a T/F-transform (hybrid QMF analysis) may be executed. As the first processing step the converter transforms L=2048 samples of the $N_{in}$ channel time domain input signal $[\tilde{y}_{ch,1}^{v} \ldots \tilde{y}_{ch,N_{in}}^{v}]=\tilde{y}_{ch}^{v}$ to a hybrid QMF $N_{in}$ channel signal representation consisting of $L_n$=32 QMF time slots (slot index n) and K=77 frequency bands (band index k). A QMF analysis according to ISO/IEC 23003-2:2010, subclause 7.14.2.2, is performed first $$[\hat{y}_{ch,1}^{n,k} \ldots \hat{y}_{ch,N_{in}}^{n,k}]=\hat{y}_{ch}^{n,k}=\text{QmfAnalysis}(\tilde{y}_{ch}^{v})$$
$$\text{with } 0 \le v < L \text{ and } 0 \le n < L_n,$$

followed by a hybrid analysis $$[y_{ch,1}^{n,k} \ldots y_{ch,N_{in}}^{n,k}]=y_{ch}^{n,k}=\text{HybridAnalysis}(\hat{y}_{ch}^{n,k}).$$

The hybrid filtering shall be carried out as described in 8.6.4.3 of ISO/IEC 14496-3:2009. However, the low frequency split definition (Table 8.36 of ISO/IEC 14496-3: 2009) may be replaced by the following table:

Overview of low frequency split for the 77 band hybrid filterbank

| QMF subband p | Number of bands $Q^p$ | Filter |
|---|---|---|
| 0 | 8 | Type A |
| 1 | 4 | |
| 2 | 4 | |

Further, the prototype filter definitions have to be replaced by the coefficients in the following table:

Prototype filter coefficients for the filters that split the lower QMF subbands for the 77 band hybrid filterbank

| n | $g^0[n]$, $Q^0 = 8$ | $g^{1,2}[n]$, $Q^{1,2} = 4$ |
|---|---|---|
| 0 | 0.00746082949812 | −0.00305151927305 |
| 1 | 0.02270420949825 | −0.00794862316203 |
| 2 | 0.04546865930473 | 0.0 |

-continued

| Prototype filter coefficients for the filters that split the lower QMF subbands for the 77 band hybrid filterbank | | |
|---|---|---|
| n | $g^0[n]$, $Q^0 = 8$ | $g^{1,2}[n]$, $Q^{1,2} = 4$ |
| 3 | 0.07266113929591 | 0.04318924038756 |
| 4 | 0.09885108575264 | 0.12542448210445 |
| 5 | 0.11793710567217 | 0.21227807049160 |
| 6 | 0.125 | 0.25 |
| 7 | 0.11793710567217 | 0.21227807049160 |
| 8 | 0.09885108575264 | 0.12542448210445 |
| 9 | 0.07266113929591 | 0.04318924038756 |
| 10 | 0.04546865930473 | 0.0 |
| 11 | 0.02270420949825 | −0.00794862316203 |
| 12 | 0.00746082949812 | −0.00305151927305 |

Figure 10:
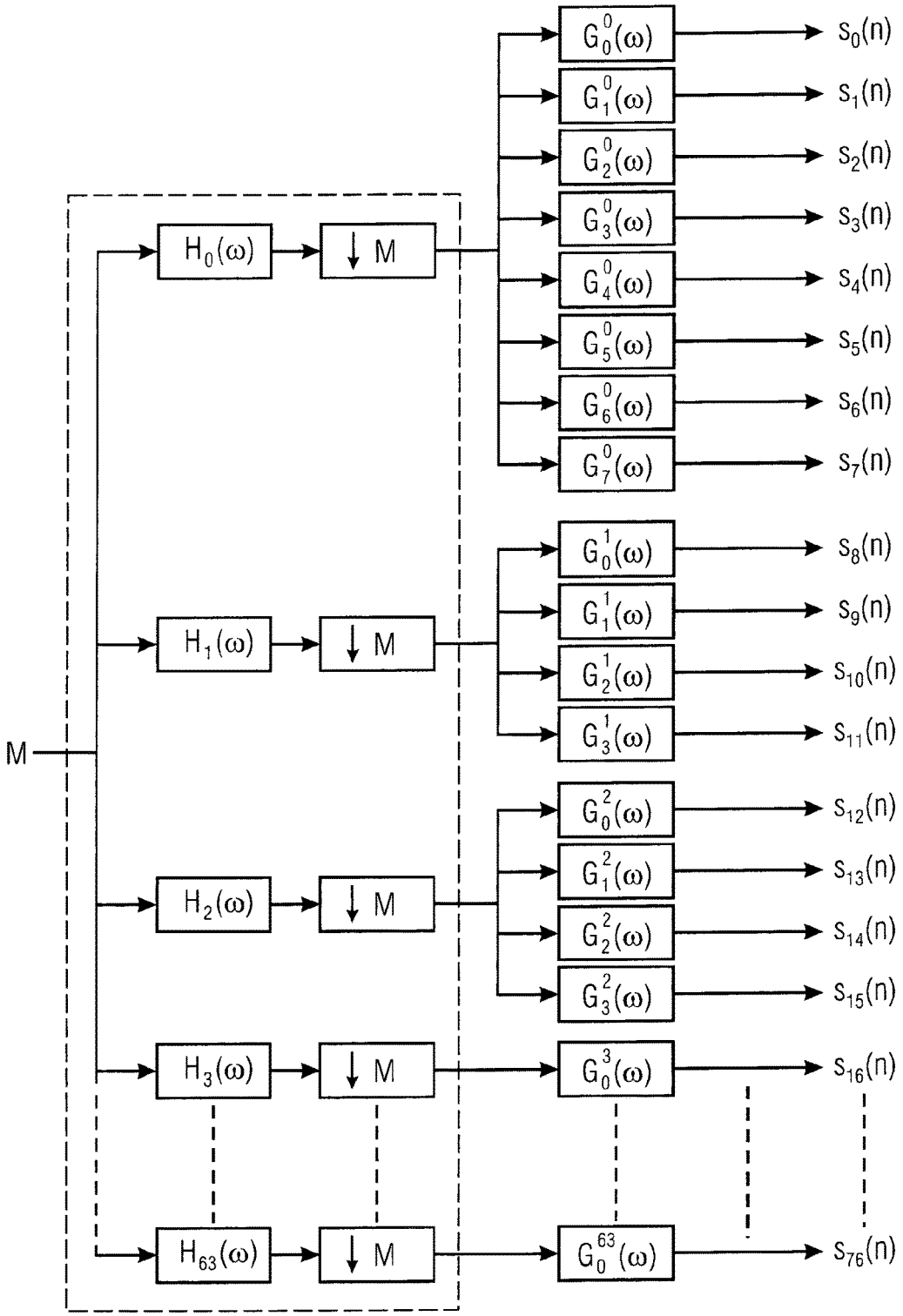

Further, contrary to 8.6.4.3 of ISO/IEC 14496-3:2009, no sub-subbands are combined, i.e. by splitting the lowest 3 QMF subbands into (8, 4, 4) sub-subbands a 77 band hybrid filterbank is formed. The 77 hybrid QMF bands are not reordered, but passed on in the order that follows from the hybrid filterbank, see FIG. 10.

Now, static equalizer gains may be applied. The converter 42 applies zero-phase gains to the input channels 38 as signalled by the $I_{EQ}$ and $G_{EQ}$ variables.

$I_{EQ}$ is a vector of length $N_{in}$ that signals for each channel A of the $N_{in}$ input channels

- either that no equalizing filter has to be applied to the particular input channel: $I_{EQ,A}=0$,
- or that the gains of $G_{EQ}$ corresponding to the equalizer filter with index $I_{EQ,A}>0$ have to be applied.

In case $I_{EQ,A}>0$ for input channel A, the input signal of channel A is filtered by multiplication with zero-phase gains obtained from the column of the $G_{EQ}$ matrix signalled by the $I_{EQ,A}$:

$$y_{EQ,ch,A}^{n,k} = \begin{cases} y_{ch,A}^{n,k} \cdot G_{EQ,I_{EQ,A}}^{k} & \text{if } I_{EQ,A} > 0 \\ y_{ch,A}^{n,k} & \text{if } I_{EQ,A} = 0 \end{cases}$$

Note that all following processing steps until the transformation back to time domain signals are carried out individually for each hybrid QMF frequency band k and independently of k. The frequency band parameter k is thus omitted in the following equations, e.g. $y_{EQ,\,ch}^{n}=y_{EQ,\,ch}^{n,k}$ for each frequency band k.

Further, an update of input data and a signal adaptive input data windowing may be performed. Let F be a monotonically increasing frame index denoting the current frame of input data, e.g. $y_{EQ,\,ch}^{F,n}=y_{EQ,\,ch}^{n}$ for frame F, starting at F=0 for the first frame of input data after initialization of the format converter 42. An analysis frame of length $2*L_n$ is formulated from the input hybrid QMF spectra as $$y_{in,ch}^{F,n} = \begin{cases} 0 & \text{for } 0 \le n < L_n,\ F = 0 \\ y_{in,ch}^{F-1,n+L_n} & \text{for } 0 \le n < L_n,\ F > 0 \\ y_{EQ,ch}^{F,n-L_n} & \text{for } L_n \le n < 2L_n,\ F \ge 0 \end{cases}.$$

The analysis frame is multiplied by an analysis window $w^{F,n}$ according to $$y_{w,ch}^{F,n}=y_{in,ch}^{F,n}\cdot w^{F,n} \text{ for } 0\le n<2L_n,$$

where $w^{F,n}$ is a signal adaptive window that is computed for each frame F as follows:

$$U^{F,n} = \begin{cases} eps & \text{for } n = 0,\ F = 0 \\ \sum_{A=1}^{N_{in}} \left|y_{in,ch,A}^{F-1,L_n-1}\right|^2 & \text{for } n = 0,\ F > 0 \\ eps + \sum_{A=1}^{N_{in}} \left|y_{in,ch,A}^{F,n-1}\right|^2 & \text{for } 1 \le n \le L_n,\ F \ge 0 \end{cases},$$

$$W^{F,n} = eps + \left|10\log_{10}\left(\frac{U^{F,n+1}}{U^{F,n}}\right)\right| \cdot (U^{F,n+1} + U^{F,n}) \text{ for } 0 \le n < L_n,$$

$$W_{cumsum}^{F,n} = \sum_{m=0}^{n} W^{F,m} \text{ for } 0 \le n < L_n,$$

$$w^{F,n} = \begin{cases} 1 - w^{F-1,n+L_n} & \text{for } 0 \le n < L_n \\ 1 - \frac{W_{cumsum}^{F,n-L_n}}{W_{cumsum}^{F,L_n-1}} & \text{for } L_n \le n < 2L_n \end{cases}.$$

Now, a covariance analysis may be performed. A covariance analysis is performed on the windowed input data, where the expectation operator E(·) is implemented as a summation of the auto-/cross-terms over the $2L_n$ QMF time slots of the windowed input data frame F. The next processing steps are performed independently for each processing frame F. The index F is thus omitted until needed for clarity, e.g. $y_{w,\,ch}^{n}=y_{w,\,ch}^{F,n}$ for frame F.

Note that $y_{w,\,ch}^{n}$ denotes a row vector with $N_{in}$ elements in case of $N_{in}$ input channels. The covariance value matrix is thus formed as $$C_y = E((y_{w,ch}^{n})^T (y_{w,ch}^{n})^*) = \sum_{n=0}^{2L_n-1} (y_{w,ch}^{n})^T (y_{w,ch}^{n})^*,$$

where $(\cdot)^T$ denotes the transpose and $(\cdot)^*$ denotes the complex conjugate of a variable and $C_y$ is an $N_{in}\times N_{in}$ matrix that is calculated once per frame F.

From the covariance matrix $C_y$ inter-channel correlation coefficients between the channels A and B are derived as $$ICC_{A,B} = \frac{|C_{y,A,B}|}{eps + \sqrt{C_{y,A,A} \cdot C_{y,B,B}}},$$

where the two indices in a notation $C_{y,a,b}$ denote the matrix element in the a th row and bth column of $C_y$.

Further, a phase-alignment matrix may be formulated. The $ICC_{A,B}$ values are mapped to an attraction measure matrix T with elements $$T_{A,B} = \begin{cases} \min(0.25, \max(0, 0.625 \cdot ICC_{A,B} - 0.3)) & \text{for } A \ne B \\ 1 & \text{for } A = B \end{cases},$$

and an intermediate phase-aligning mixing matrix $M_{int}$, (equivalent to the normalized phase alignment coefficient matrix $\hat{M}$ in the previous embodiments) is formulated. With an attraction value matrix $$P_{A,B}=T_{A,B}\cdot C_{y,A,B} \text{ and}$$

$$V=M_{DMX}P$$

the matrix elements are derived as $$M_{int,A,B}=M_{DMX,A,B}\cdot\exp(j\arg(V_{A,B})),$$

where exp(·) denotes the exponential function, $j=\sqrt{-1}$ is the imaginary unit, and arg(·) returns the argument of complex valued variables.

The intermediate phase-aligning mixing matrix $M_{int}$ is modified to avoid abrupt phase shifts, resulting in $M_{mod}$: First, a weighting matrix $D^F$ is defined for each frame F as a diagonal matrix with elements $D_{A,A}{}^F=\sqrt{C_{y,A,A}{}^F}$. The phase change of the mixing matrix over time (i.e. over frames) is measured by comparing the current weighted intermediate mixing matrix and the weighted resulting mixing matrix $M_{mod}$ of the previous frame:

$$M^F_{cmp_curr} = M^F_{int}D^F,$$

$$M^F_{cmp_prev} = \begin{cases} M_{DMX} & \text{for } F = 0 \\ M^{F-1}_{mod}D^{F-1} & \text{for } F > 0 \end{cases},$$

$$M^F_{cmp_cross,A,B} = M^F_{cmp_curr,A,B}\cdot(M^F_{cmp_prev,A,B})^*,$$

$$M^F_{cmp} = M^F_{cmp_cross}T^F,$$

$$\theta^F_{A,B} = \arg(M^F_{cmp,A,B}).$$

The measured phase change of the intermediate mixing matrix is processed to obtain a phase-modification parameter that is applied to the intermediate mixing matrix $M_{int}$, resulting in $M_{mod}$ (equivalent to the regularized phase alignment coefficient matrix $\tilde{M}$):

$$\theta^F_{mod,A,B} = -\mathrm{sgn}(\theta^F_{A,B})\cdot\max\left(0, |\theta^F_{A,B}| - \frac{\pi}{4}\right),$$

$$M^F_{mod,A,B} = M^F_{int,A,B}\cdot\exp(j\cdot\theta^F_{mod,A,B}).$$

An energy scaling is applied to the mixing matrix to obtain the final phase-aligning mixing matrix $M_{PA}$. With $M_{Cy}=M_{mod}C_yM_{mod}{}^H$ where $(\cdot)^H$ denotes the conjugate transpose operator, and $$S_B = \sqrt{\frac{\sum_{A=1}^{N_{in}} M_{DMX,B,A}\cdot M_{DMX,B,A}\cdot C_{y,A,A}}{eps + M_{Cy,B,B}}},$$

$$S_{lim,B} = \min(S_{max}, \max(S_{min}, S_B)),$$

where the limits are defined as $S_{max}=10^{0.4}$ and $S_{min}=10^{-0.5}$, the final phase-aligning mixing matrix elements follow as $$M_{PA,B,A}=S_{lim,B}\cdot M_{mod,B,A}.$$

In a further step, output data may be calculated. The output signals for the current frame F are calculated by applying the same complex valued downmix matrix $M_{PA}{}^F$ to all $2L_n$ time slots n of the windowed input data vector $y_{w,ch}{}^n$:

$$\tilde{z}^{F,n}_{ch} = \left(M^F_{PA}(y^{F,n}_{w,ch})^T\right)^T \text{ for } 0 \le n < 2L_n.$$

An overlap-add step is applied to the newly calculated output signal frame $\tilde{z}_{ch}{}^{F,n}$ to arrive at the final frequency domain output signals comprising $L_n$ samples per channel for frame F, $$z^{F,n}_{ch} = \begin{cases} \tilde{z}^{F,n}_{ch} & \text{for } F = 0,\ 0 \le n < L_n \\ \tilde{z}^{F,n}_{ch} + \tilde{z}^{F-1,n+L_n}_{ch} & \text{for } F > 0,\ 0 \le n < L_n \end{cases}$$

Now, an F/T-transformation (hybrid QMF synthesis) may be performed. Note that the processing steps described above have to be carried out for each hybrid QMF band k independently. In the following formulations the band index k is reintroduced, i.e. $z_{ch}{}^{F,n,k}=z_{ch}{}^{F,n}$. The hybrid QMF frequency domain output signal $Z_{ch}{}^{F,n,k}$ is transformed to an $N_{out}$-channel time domain signal frame of length L time domain samples per output channel B, yielding the final time domain output signal $\tilde{z}_{ch}{}^{F,\nu}$.

The Hybrid Synthesis $$\hat{z}_{ch}{}^{F,n,k}=\mathrm{HybridSynthesis}(z_{ch}{}^{F,n,k})$$

may be carried out as defined in Figure 8.21 of ISO/IEC 14496-3:2009, i.e. by summing the sub-subbands of the three lowest QMF subbands to obtain the three lowest QMF subbands of the 64 band QMF representation. However, the processing shown in Figure 8.21 of ISO/IEC 14496-3:2009 has to be adapted to the (8, 4, 4) low frequency band splitting instead of the shown (6, 2, 2) low frequency splitting.

The Subsequent QMF Synthesis $$\tilde{z}_{ch}{}^{F,\nu}=\mathrm{QMFSynthesis}(\hat{z}_{ch}{}^{F,n,k})$$

may be carried out as defined in ISO/IEC 23003-2:2010, subclause 7.14.2.2.

If the output loudspeaker positions differ in radius (i.e. if $trim_A$ is not the same for all output channels A) the compensation parameters derived in the initialization may be applied to the output signals. The signal of output channel A shall be delayed by $T_{d,A}$ time domain samples and the signal shall also be multiplied by the linear gain $T_{g,A}$.

With respect to the decoder and encoder and the methods of the described embodiments the following is mentioned:

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An audio signal processing decoder comprising at least one frequency band and being configured for processing an input audio signal comprising a plurality of input channels in the at least one frequency band, wherein the decoder is configured to align the phases of the input channels depending on inter-channel dependencies between the input channels, wherein the phases of input channels are the more aligned with respect to each other the higher their inter-channel dependency is; and to downmix the aligned input audio signal to an output audio signal comprising a lesser number of output channels than the number of the input channels.

2. The decoder according to claim 1, wherein the decoder is configured to analyze the input audio signal in the frequency band, in order to identify the inter-channel dependencies between the input audio channels or to receive the inter-channel dependencies between the input channels from an external device, which provides the input audio signal.

3. The decoder according to claim 1, wherein the decoder is configured to normalize the energy of the output audio signal based on a determined energy of the input audio signal, wherein the decoder is configured to determine the signal energy of the input audio signal or to receive the determined energy of the input audio signal from an external device, which provides the input audio signal.

4. The decoder according to claim 1, wherein the decoder comprises a downmixer for downmixing the input audio signal based on a downmix matrix, wherein the decoder is configured to calculate the downmix matrix, in such way that the phases of the input channels are aligned based on the identified inter-channel dependencies or to receive a downmix matrix calculated in such way that the phases of the input channels are aligned based on the identified inter-channel dependencies from an external device, which provides the input audio signal.

5. The decoder according to claim 4, wherein the decoder is configured to calculate the downmix matrix in such way that the energy of the output audio signal is normalized based on the determined energy of the input audio signal or to receive the downmix matrix, calculated in such way that the energy of the output audio signal is normalized based on the determined energy of the input audio signal from an external device, which provides the input audio signal.

6. The decoder according to claim 1, wherein the decoder is configured to analyze time intervals of the input audio signal using a window function, wherein the inter-channel dependencies are determined for each time frame or wherein the decoder is configured to receive an analysis of time intervals of the input audio signal using a window function, wherein the inter-channel dependencies are determined for each time frame, from an external device, which provides the input audio signal.

7. The decoder according to claim 1, wherein the decoder is configured to calculate a covariance value matrix, wherein the covariance values express the inter-channel dependency of a pair of input audio channels or wherein the decoder is configured to receive a covariance value matrix, wherein the covariance values express the inter-channel dependency of a pair of input audio channels, from an external device, which provides the input audio signal.

8. The decoder according to claim 7, wherein the decoder is configured to establish an attraction value matrix by applying a mapping function to the covariance value matrix, wherein the gradient of the mapping function is preferably bigger or equal to zero for all covariance values and wherein the mapping function preferably reaches values between zero and one for input values between zero and one.

9. The decoder according to claim 8, wherein the mapping function is a non-linear function.

10. The decoder according to claim 8, wherein the mapping function is equal to zero for covariance values or values derived from the covariance values being smaller than a first mapping threshold.

11. The decoder according to claim 8, wherein the mapping function is represented by a function forming an S-shaped curve.

12. The decoder according to claim 7, wherein the decoder is configured to calculate a phase alignment coefficient matrix, wherein the phase alignment coefficient matrix is based on the covariance value matrix and on a prototype downmix matrix or to receive a phase alignment coefficient matrix, wherein the phase alignment coefficient matrix is based on the covariance value matrix and on a prototype downmix matrix, from an external device, which provides the input audio signal.

13. The decoder according to claim 12, wherein the phases and/or the amplitudes of the downmix coefficients of the downmix matrix are formulated to be smooth over time, so that temporal artifacts due to signal cancellation between adjacent time frames are avoided.

14. The decoder according to claim 12, wherein the phases and/or the amplitudes of the downmix coefficients of the downmix matrix are formulated to be smooth over frequency, so that spectral artifacts due to signal cancellation between adjacent frequency bands are avoided.

15. The decoder according to claim 12, wherein the decoder is configured to establish a regularized phase alignment coefficient matrix based on the phase alignment coefficient matrix or to receive a regularized phase alignment coefficient matrix based on the phase alignment coefficient matrix from an external device, which provides the input audio signal.

16. The decoder according to claim 15, wherein the downmix matrix is based on the regularized phase alignment coefficient matrix.

17. An audio signal processing encoder comprising at least one frequency band and being configured for processing an input audio signal comprising a plurality of input channels in the at least one frequency band, wherein the encoder is configured to align the phases of the input channels depending on inter-channel dependencies between the input channels, wherein the phases of input channels are the more aligned with respect to each other the higher their inter-channel dependency is; and to downmix the aligned input audio signal to an output audio signal comprising a lesser number of output channels than the number of the input channels.

18. An audio signal processing encoder comprising at least one frequency band and being configured for outputting a bitstream, wherein the bitstream comprises an encoded audio signal in the frequency band, wherein the encoded audio signal comprises a plurality of encoded channels in the at least one frequency band, wherein the encoder is configured to calculate a downmix matrix for a downmixer for downmixing the encoded audio signal based on the downmix matrix in such way that the phases of the encoded channels are aligned based on identified inter-channel dependencies, wherein the phases of the encoded channels are the more aligned with respect to each other the higher their inter-channel dependency is, preferably in such way that the energy of an output audio signal of the downmixer is normalized based on determined energy of the encoded audio signal, and to output the downmix matrix within the bitstream.

19. The audio signal processing encoder according to claim 18, wherein the encoder is configured to determine inter-channel dependencies between the encoded channels of the encoded audio signal and to output the inter-channel dependencies within the bitstream.

20. The audio signal processing encoder according to claim 18, wherein the encoder is configured to analyze time intervals of the encoded audio signal using a window function, wherein the inter-channel dependencies are determined for each time frame, and to output the inter-channel dependencies for each time frame within the bitstream.

21. The audio signal processing encoder according to claim 18, wherein the encoder is configured to output the covariance value matrix within the bitstream.

22. The audio signal processing encoder according to claim 18, wherein the encoder is configured to establish a regularized phase alignment coefficient matrix based on the phase alignment coefficient matrix and to output the regularized phase alignment coefficient matrix within the bitstream.

23. A system comprising:

an audio signal processing decoder comprising at least one frequency band and being configured for processing an input audio signal comprising a plurality of input channels in the at least one frequency band, wherein the decoder is configured to align the phases of the input channels depending on inter-channel dependencies between the input channels, wherein the phases of input channels are the more aligned with respect to each other the higher their inter-channel dependency is; and to downmix the aligned input audio signal to an output audio signal comprising a lesser number of output channels than the number of the input channels, and an audio signal processing encoder according to claim 17.

24. A system comprising:

an audio signal processing decoder comprising at least one frequency band and being configured for processing an input audio signal comprising a plurality of input channels in the at least one frequency band, wherein the decoder is configured to align the phases of the input channels depending on inter-channel dependencies between the input channels, wherein the phases of input channels are the more aligned with respect to each other the higher their inter-channel dependency is; and to downmix the aligned input audio signal to an output audio signal comprising a lesser number of output channels than the number of the input channels, and an audio signal processing encoder according to claim 18.

25. A method for processing an input audio signal comprising a plurality of input channels in a frequency band, comprising:

analyzing the input audio signal in the frequency band, wherein inter channel dependencies between the input audio channels are identified;

aligning the phases of the input channels based on the identified inter channel dependencies, wherein the phases of the input channels are the more aligned with respect to each other the higher their inter channel dependency is; and downmixing the aligned input audio signal to an output audio signal comprising a lesser number of output channels than the number of the input channels in the frequency band.

26. A non-transitory digital storage medium having stored thereon a computer program with program code for implementing the method of claim 25 when being executed on a computer or signal processor.

27. The decoder according to claim 8, wherein the mapping function is equal to one for covariance values or values derived from the covariance values being bigger than a second mapping threshold.

28. The audio signal processing encoder according to claim 18, wherein the encoder is configured to calculate a covariance value matrix, wherein the covariance values express the inter-channel dependency of a pair of encoded audio channels, to establish an attraction value matrix by applying a mapping function to the covariance value matrix, wherein the gradient of the mapping function is preferably bigger or equal to zero for all covariance values and wherein the mapping function preferably reaches values between zero and one for in-put values between zero and one, in particular a non-linear function, in particular a mapping function, which is equal to zero for covariance values being smaller than a first mapping threshold and/or which is equal to one for covariance values being bigger than a second mapping threshold, and to output the attraction value matrix within the bitstream.

29. The audio signal processing encoder according to claim 28, wherein the encoder is configured to calculate a phase alignment coefficient matrix, wherein the phase alignment coefficient matrix is based on the covariance value matrix and on a prototype downmix matrix.

30. The audio signal processing encoder according to claim 18, wherein the encoder is configured to determine the energy of the encoded audio signal and to output the determined energy of the encoded audio signal within the bitstream.

31. The decoder according to claim 7, wherein the decoder is configured to establish an attraction value matrix by applying a mapping function to a matrix derived from the covariance value matrix, wherein the gradient of the mapping function is preferably bigger or equal to zero for all values derived from the covariance values and wherein the mapping function preferably reaches values between zero and one for input values between zero and one.

32. The decoder according to claim 7, wherein the decoder is configured to receive an attraction value matrix established by applying a mapping function to the covariance value matrix, wherein the gradient of the mapping function is preferably bigger or equal to zero for all covariance values, and wherein the mapping function preferably reaches values between zero and one for input values between zero and one.

33. The decoder according to claim 7, wherein the decoder is configured to receive an attraction value matrix established by applying a mapping function to a matrix derived from the covariance value matrix, wherein the gradient of the mapping function is preferably bigger or equal to zero for all values derived from the covariance values and wherein the mapping function preferably reaches values between zero and one for input values between zero and one.

34. The audio signal processing encoder according to claim 18, wherein in particular the phases and/or amplitudes of downmix coefficients of the downmix matrix are formulated to be smooth over time, so that temporal artifacts due to signal cancellation between adjacent time frames are avoided.

35. The audio signal processing encoder according to claim 18, wherein in particular the phases and/or amplitudes of downmix coefficients of the downmix matrix are formulated to be smooth over frequency, so that spectral artifacts due to signal cancellation between adjacent frequency bands are avoided.

36. The audio signal processing encoder according to claim 18, wherein the encoder is configured to calculate a covariance value matrix, wherein the covariance values express the inter-channel dependency of a pair of encoded audio channels, and to establish an attraction value matrix by applying a mapping function to a matrix derived from the covariance value matrix, wherein the gradient of the mapping function is preferably bigger or equal to zero for all values derived from the covariance values and wherein the mapping function preferably reaches values between zero and one for input values between zero and one, in particular a non-linear function, in particular a mapping function, which is equal to zero for values derived from the covariance values being smaller than a first mapping threshold and/or which is equal to one for values derived from the covariance values being bigger than a second mapping threshold, and to output the attraction value matrix within the bitstream.

37. The audio signal processing encoder according to claim 18, wherein the encoder is configured to calculate a covariance value matrix, wherein the covariance values express the inter-channel dependency of a pair of encoded audio channels, to establish an attraction value matrix by applying a mapping function to the covariance value matrix, wherein the gradient of the mapping function is preferably bigger or equal to zero for all covariance values and wherein the mapping function preferably reaches values between zero and one for input values between zero and one, in particular a non-linear function, in particular a mapping function, which is represented by a function forming an S-shaped curve, and to output the attraction value matrix within the bitstream.

38. The audio signal processing encoder according to claim 18, wherein the encoder is configured to calculate a covariance value matrix, wherein the covariance values express the inter-channel dependency of a pair of encoded audio channels, and to establish an attraction value matrix by applying a mapping function to a matrix derived from the covariance value matrix, wherein the gradient of the mapping function is preferably bigger or equal to zero for all values derived from the covariance values and wherein the mapping function preferably reaches values between zero and one for input values between zero and one, in particular a non-linear function, in particular a mapping function, which is represented by a function forming an S-shaped curve, and to output the attraction value matrix within the bitstream.

* * * * *